US005867814A

United States Patent [19]

Yong

[11] Patent Number: 5,867,814

[45] **Date of Patent: *Feb. 2, 1999**

[54] SPEECH CODER THAT UTILIZES CORRELATION MAXIMIZATION TO ACHIEVE FAST EXCITATION CODING, AND ASSOCIATED CODING METHOD

[75] Inventor: Mei Yong, Los Altos, Calif.

[73] Assignee: National Semiconductor Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 560,082

[22] Filed: Nov. 17, 1995

[51] Int. Cl.[6] ..... G10L 3/02

[52] U.S. Cl. ..... 704/216; 704/214; 704/219; 704/221; 704/222; 704/223

[58] Field of Search ..... 395/2.1, 2.2, 2.23, 395/2.28, 2.29, 2.3–2.32

[56] References Cited

U.S. PATENT DOCUMENTS

| | | | |
|---|---|---|---|
| 5,295,224 | 3/1994 | Makamura et al. | 395/2.32 |
| 5,307,441 | 4/1994 | Tzeng | 39/2.31 |
| 5,327,519 | 7/1994 | Haggvist et al. | 395/2.28 |
| 5,550,543 | 8/1996 | Chen et al. | 341/94 |

FOREIGN PATENT DOCUMENTS

| | | |
|---|---|---|
| 4315315 A1 | 11/1994 | Germany . |
| 2 173 679 | 10/1986 | United Kingdom . |

OTHER PUBLICATIONS

Atal et al, "A New Model of LPC Excitation for Producing Natural–Sounding Speech at Low Bit Rates", *Acoustics Speech & Signal Processing International Conference*, Bell Laboratories, 1982, pp. 614–617.

"Dual Rate Speech Coder for Multimedia Communications Transmitting at 5.3 & 6.3 kbits/s," Draft G.723, Telecommunication Standardization Sector of ITU, 7 Jul. 1995, 37 pages.

*Primary Examiner*—Allen R. MacDonald
*Assistant Examiner*—Alphonso A. Collins
*Attorney, Agent, or Firm*—Skjerven, Morrill MacPherson, Franklin, & Friel LLP; Ronald J. Meetin

[57] ABSTRACT

A speech coder, formed with a digital speech encoder and a digital speech decoder, utilizes fast excitation coding to reduce the computation power needed for compressing digital samples of an input speech signal to produce a compressed digital speech datastream that is subsequently decompressed to synthesize digital output speech samples. Much of the fast excitation coding is furnished by an excitation search unit in the encoder. The search unit determines excitation information that defines a non-periodic group of excitation pulses The optimal location of each pulse in the non-periodic pulse group is chosen from a corresponding set of pulse positions stored in the encoder. The search unit ascertains the optimal pulse positions by maximizing the correlation between (a) a target group of filtered versions of digital input speech samples provided to the encoder for compression and (b) a corresponding group of synthesized digital speech samples. The synthesized sample group depends on the pulse positions available in the corresponding sets of stored pulse positions and on the signs of the pulses at those positions.

22 Claims, 5 Drawing Sheets

SPEECH CODER THAT UTILIZES CORRELATION MAXIMIZATION TO ACHIEVE FAST EXCITATION CODING, AND ASSOCIATED CODING METHOD

FIELD OF USE

This invention relates to the encoding of speech samples for storage or transmission and the subsequent decoding of the encoded speech samples.

BACKGROUND ART

A digital speech coder is part of a speech communication system that typically contains an analog-to-digital converter ("ADC"), a digital speech encoder, a data storage or transmission mechanism, a digital speech decoder, and a digital-to-analog converter ("DAC"). The ADC samples an analog input speech waveform and converts the (analog) samples into a corresponding datastream of digital input speech samples. The encoder applies a coding to the digital input datastream in order to compress it into a smaller datastream that approximates the digital input speech samples. The compressed digital speech datastream is stored in the storage mechanism or transmitted by way of the transmission mechanism to a remote location.

The decoder, situated at the site of the storage mechanism or at the remote location, decompresses the compressed digital datastream to produce a datastream of digital output speech samples. The DAC then converts the decompressed digital output datastream into a corresponding analog output speech waveform that approximates the analog input speech waveform. The encoder and decoder form a speech coder commonly referred to as a coder/decoder or codec.

Speech is produced as a result of acoustical excitation of the human vocal tract. In the well-known linear predictive coding ("LPC") model, the vocal tract function is approximated by a time-varying recursive linear filter, commonly termed the formant synthesis filter, obtained from directly analyzing speech waveform samples using the LPC technique. Glottal excitation of the vocal track occurs when air passes the vocal cords. The glottal excitation signals, although not representable as easily as the vocal tract function, can generally be represented by a weighted sum of two types of excitation signals: a quasi-periodic excitation signal and a noise-like excitation signal. The quasi-periodic excitation signal is typically approximated by a concatenation of many short waveform segments where, within each segment, the waveform is periodic with a constant period termed the average pitch period. The noise-like signal is approximated by a series of non-periodic pulses or white noise.

The pitch period and the characteristics of the formant synthesis filter change continuously with time. To reduce the data rate required to transmit the compressed speech information, the pitch data and the format filter characteristics are periodically updated. This typically occurs at intervals of 10 to 30 milliseconds.

The Telecommunication Standardization Sector of the International Telecommunication Union ("ITU") is in the process of standardizing a dual-rate digital speech coder for multi-media communications. "Dual Rate Speech Coder for Multimedia Communications Transmitting at 5.3 & 6.3 kbits/s," Draft G.723, Telecommunication Standardization Sector of ITU, 7 Jul. 1995, 37 pages (hereafter referred to as the "July 1995 G.723 specification"), presents a description of this standardized ITU speech coder (hereafter the "G.723 coder"). Using linear predictive coding in combination with an analysis-by-synthesis technique, the digital speech encoder in the G.723 coder generates a compressed digital speech datastream at a data rate of 5.3 or 6.3 kilobits/second ("kbps") starting from an uncompressed input digital speech datastream at a data rate of 128 kbps. The 5.3-kbps or 6.3 kbps compressed data rate is selectively set by the user.

After decompression of the compressed datastream, the digital speech signal produced by the G.723 coder is of excellent communication quality. However, a high computation capability is needed to implement the G.723 coder. In particulars the G.723 coder typically requires approximately twenty million instructions per second of processing power furnished by a dedicated digital signal processor. A large portion of the G.723 coder's processing capability is utilized in performing energy error minimization during the generation of codebook excitation information.

In software running on a general purpose computer such as a personal computer, it is difficult to attain the data processing capability needed for the G.723 coder. A digital speech coder that provides communication quality comparable to that of the G.723 coder but at a considerably reduced computation power is desirable.

GENERAL DISCLOSURE OF THE INVENTION

The present invention furnishes a speech coder that employs fast excitation coding to reduce the number of computations, and thus the computation power, needed for compressing digital samples of an input speech signal to produce a compressed digital speech datastream which is subsequently decompressed to synthesize digital output speech samples. In particular, the speech coder of the invention requires considerably less computation power than the G.723 speech coder to perform identical speech compression/decompression tasks. Importantly, the communication quality achieved by the present coder is comparable to that achieved with the G.723 coder. Consequently, the present speech coder is especially suitable for applications such as personal computers.

The coder of the invention contains a digital speech encoder and a digital speech decoder. In compressing the digital input speech samples, the encoder generates the outgoing digital speech datastream according to the format prescribed in the July 1995 G.723 specification. The present coder is thus interoperable with the G.723 coder. In short, the coder of the invention is a highly attractive alternative to the G.723 coder.

Fast excitation coding in accordance with the invention is provided by an excitation search unit in the encoder. The search unit, sometimes referred to as a fixed codebook search unit, determines excitation information that defines a non-periodic group of excitation pulses. The optimal position of each pulse in the non-periodic pulse group is selected from a corresponding set of pulse positions stored in the encoder. Each pulse is selectable to be of positive or negative sign.

The search unit determines the optimal positions of the pulses by maximizing the correlation between (a) a target group of consecutive filtered versions of digital input speech samples provided to the encoder for compression and (b) a corresponding group of consecutive synthesized digital speech samples. The synthesized sample group depends on the pulse positions available in the corresponding sets of pulse positions stored in the encoder and on the signs of the pulses at those positions. Performing a correlation maximization, especially in the manner described below, requires much less computation than the energy error minimization technique used to achieve similar results in the G.723 coder.

The correlation maximization in the present invention entails maximizing correlation C given as:

$$C = \sum_{n=0}^{n_G-1} t_B(n)q(n) \tag{A}$$

where n is a sample number in both the target sample group and the corresponding synthesized sample group, $t_B(n)$ is the target sample group, q(n) is the corresponding synthesized sample group, and $n_G$ is the total number of samples in each of $t_B(n)$ and q(n).

Maximizing correlation C, as given in Eq. A, is preferably accomplished by implementing the search unit with an inverse filter, a pulse position table, and a selector. The inverse filter inverse filters the target sample group to produce a corresponding inverse-filtered group of consecutive digital speech samples. The pulse position table stores the sets of pulse positions. The selector selects the position of each pulse according to the pulse position that maximizes the absolute value of the inverse-filtered sample group.

Specifically, maximizing correlation C given from Eq. A is equivalent to maximizing correlation C given by:

$$C = \sum_{j=1}^{M} |f(m_j)| \tag{B}$$

where j is a running integer, M is the total number of pulses in the non-periodic excitation sample group, $m_j$ is the position of j-th pulse in the corresponding set of pulse positions, and $|f(m_j)|$ is the absolute value of a sample in the inverse-filtered sample group.

Maximizing correlation C, as given by Eq. B entails repetitively performing three operations until all the pulse positions are determined. Firstly, a search is performed for the value of sample number n that yields a maximum absolute value of $f(m_j)$. Secondly, each pulse position $m_j$ is set to the so-located value of sample number n. Finally, that pulse position $m_j$ is inhibited from being selected again. The preceding steps require comparatively little computations. In this way, the invention provides a substantial improvement over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present speech coder, formed with a digital speech encoder and a digital speech decoder, compresses a speech signal using a linear predictive coding model to establish numerical values for parameters that characterize a formant synthesis filter which approximates the filter characteristics of the human vocal tract. An analysis-by-synthesis excitation codebook search method is employed to produce glottal excitation signals for the formant synthesis filter. At the encoding side, the encoder determines coded representations of the glottal excitation signals and the formant synthesis filter parameters. These coded representations are stored or immediately transmitted to the decoder. At the decoding side, the decoder uses the coded representations of the glottal excitation signals and the formant synthesis filter parameters to generate decoded speech waveform samples.

Figure 1:
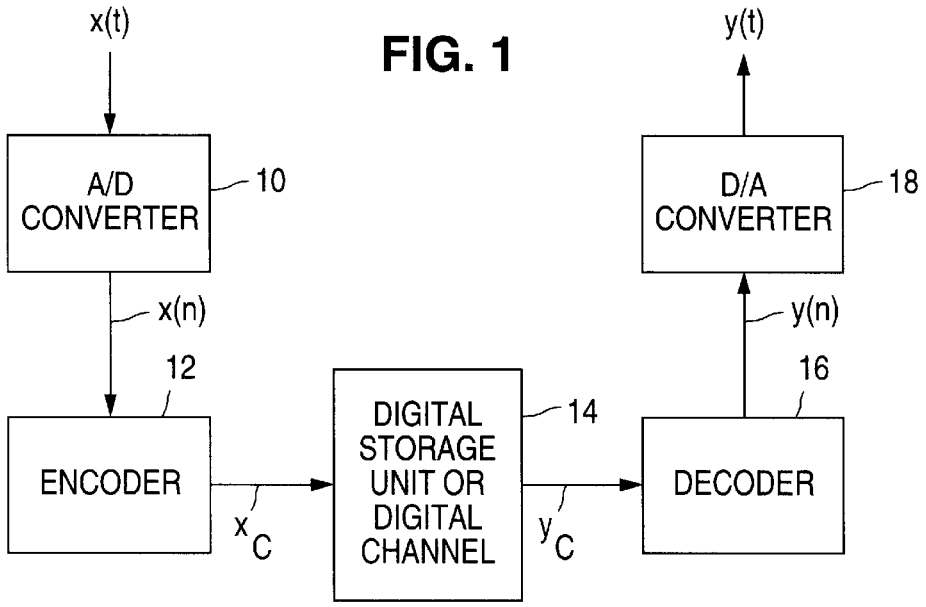
FIG. 1 is a block diagram of a speech compression/decompression system that accommodates a speech coder in accordance with the invention.

Referring to the drawings, FIG. 1 illustrates a speech compression/decompression system suitable for transmitting data representing speech (or other audio sounds) according to the digital speech coding techniques of the invention. The compression/decompression system of FIG. 1 consists of an analog-to-digital converter 10, a digital speech encoder 12, a block 14 representing a digital storage unit or a "digital" communication channel, a digital speech decoder 16, and a digital-to-analog converter 18. Communication of speech (or other audio) information via the compression/decompression system of FIG. 1 begins with an audio-to-electrical transducer (not shown), such as a microphone, that transforms input speech sounds into an analog input voltage waveform x(t), where "t" represents time.

ADC 10 converts analog input speech voltage signal x(t) into digital speech voltage samples x(n), where "n" represents the sample number. ADC 10 generates digital speech samples x(n) by uniformly sampling analog speech signal x(t) at a rate of 8,000 samples/second and then quantizing each sample into an integer level ranging from $-2^{15}$ to $2^{15}-1$. Each quantization level is defined by a 16-bit integer. The series of 16-bit numbers, termed the uncompressed input speech waveform samples, thus form digital speech samples x(n). Since 8,000 input samples are generated each second with 16 bits in each sample, the data transfer rate for uncompressed input speech waveform samples x(n) is 128 kbps.

Encoder 12 digitally compresses input speech waveform samples x(n) according to the teachings of the invention to produce a compressed digital datastream $x_C$ which represents analog input speech waveform x(t) at a much lower data transfer rate than uncompressed speech waveform samples x(n). Compressed speech datastream $x_C$ contains two primary types of information: (a) quantized line spectral pair ("LSP") data which characterizes the formant synthesis filter and (b) data utilized to excite the formant synthesis filter. Compressed speech datastream $x_C$ is generated in a manner compliant to the July 1995 G.723 specification. The data transfer rate for compressed datastream $x_C$ is selectively set by the user at 5.3 kbps or 6.3 kbps.

Speech encoder 12 operates on a frame-timing basis. Each 240 consecutive uncompressed input waveform samples x(n), corresponding to 30 milliseconds of speech (or other audio sounds), constitute a speech frame. As discussed further below, each 240-sample speech frame is divided into four 60-sample subframes. The LSP information which characterizes the formant synthesis filter is updated every 240-sample frame, while the information used for defining signals that excite the formant synthesis filter is updated every 60-sample subframe.

Compressed speech datastream $x_C$ is either stored for subsequent decompression or is transmitted on a digital communication channel to another location for subsequent decompression. Block 14 in FIG. 1 represents a storage unit that stores compressed datastream $x_C$ as well as the digital channel that transmits datastream $x_C$. Storage unit/digital channel 14 provides a compressed speech digital datastream $y_C$ which, if there are no storage or transmission errors, is identical to compressed datastream $x_C$. Compressed speech datastream $y_C$ thus also complies with the July 1995 G.723 specification. The data transfer rate for compressed datastream $y_C$ is the same (5.3 or 6.3 kbps) as compressed datastream $x_C$.

Decoder 16 decompresses compressed speech datastream $y_C$ according to an appropriate decoding procedure to produce a decompressed datastream y(n) consisting of digital output speech waveform samples. Digital output speech waveform samples y(n) are provided in the same format as digital input speech samples x(n). That is, output speech datastream y(n) consists of 16-bit samples provided at 8,000 samples/second, resulting in an outgoing data transfer rate of 128 kbps. Because some information is invariably lost in the compression/decompression process, output speech waveform samples y(n) are somewhat different from input speech waveform samples x(n).

DAC 18 converts digital output speech waveform samples y(n) into an analog output speech voltage signal y(t). Finally, an electrical-to-audio transducer (not shown), such as a speaker, transforms analog output speech signal y(t) into output speech.

The speech coder of the invention consists of encoder 12 and decoder 16. Some of the components of encoder 12 and decoder 16 preferably operate in the manner specified in the July 1995 G.723 specification. To the extent not stated here, the portions of the July 1995 G.723 specification pertinent to these coder components are herein incorporated by reference.

To understand how the techniques of the invention are applied to encoder 12, it is helpful to first look at decoder 16 in more detail. In a typical implementation, decoder 16 is configured and operates in the same manner as the digital speech decoder in the G.723 coder. Alternatively, decoder 16 can be a simplified version of the G.723 digital speech decoder. In either case, the present coder is interoperable with the G.723 coder.

Figure 2:
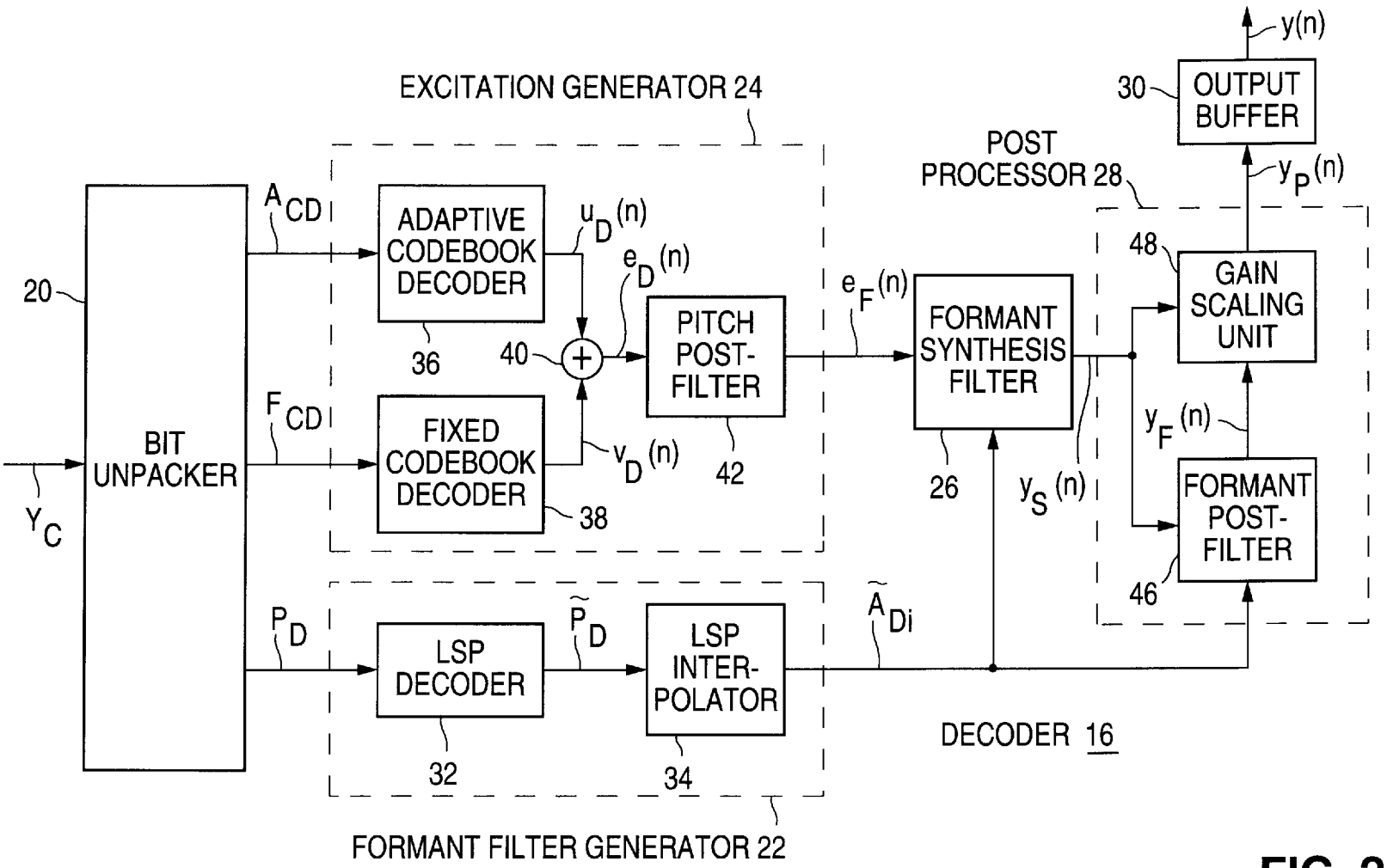
FIG. 2 is a block diagram of a digital speech decoder used in the coder contained in the speech compression/decompression system of FIG. 1.

FIG. 2 depicts the basic internal arrangement of digital speech decoder 16 when it is configured and operates in the same manner as the G.723 digital speech decoder. Decoder 16 in FIG. 2 consists of a bit unpacker 20, a format filter generator 22, an excitation generator 24, a formant synthesis filter 26, a post processor 28, and an output buffer 30.

Compressed digital speech datastream $y_C$ is supplied to bit unpacker 20. Compressed speech datastream $y_C$ contains LSP and excitation information representing compressed speech frames. Each time that bit unpacker 20 receives a block of bits corresponding to a compressed 240-sample speech frame, unpacker 20 unpacks the block to produce an LSP code $P_D$, a set $A_{CD}$ of adaptive codebook excitation parameters, and a set $F_{CD}$ of fixed codebook excitation parameters. LSP code $P_D$, adaptive excitation parameter set $A_{CD}$, and fixed excitation parameter set $F_{CD}$ are utilized to synthesize uncompressed speech frames at 240 samples per frame.

LSP code $P_D$ is 24 bits wide. For each 240-sample speech frame, formant filter generator 22 converts LSP code $P_D$ into four quantized prediction coefficient vectors $\tilde{A}_{Di}$, where i is an integer running from 0 to 3. One quantized prediction coefficient vector $\tilde{A}_{Di}$ is generated for each 60-sample subframe i of the current frame. The first through fourth 60-sample subframes are indicated by values of 0, 1, 2, and 3 for i.

Each prediction coefficient vector $\tilde{A}_{Di}$ consists of ten quantized prediction coefficients $\{\tilde{a}_{ij}\}$, where j is an integer running from 1 to 10. For each subframe i, the numerical values of the ten prediction coefficients $\{\tilde{a}_{ij}\}$ establish the filter characteristics of formant synthesis filter 26 in the manner described below.

Formant filter generator 22 is constituted with an LSP decoder 32 and an LSP interpolator 34. LSP decoder 32 decodes LSP code $P_D$ to generate a quantized LSP vector $\tilde{P}_D$ consisting of ten quantized LSP terms $\{\tilde{p}_j\}$, where j runs from 1 to 10. For each subframe i of the current frame, LSP interpolator 34 linearly interpolates between quantized LSP vector $\tilde{P}_D$ of the current speech frame and quantized LSP vector $\tilde{P}_D$ of the previous speech frame to produce an interpolated LSP vector $\tilde{P}_{Di}$ consisting of ten quantized LSP terms $\{\tilde{P}_{ij}\}$, where j again runs from 1 to 10. Accordingly, four interpolated LSP vectors $\tilde{P}_{Di}$ are produced in each frame, where i runs from 0 to 3. In addition, LSP interpolator 34 converts the four interpolated LSP vectors $\tilde{P}_{Di}$ respectively into the four quantized prediction coefficient vectors $\tilde{A}_{Di}$ that establish smooth time-varying characteristics for formant synthesis filter 26.

Excitation parameter sets $A_{CD}$ and $F_{CD}$ are furnished to excitation generator 24 for generating four composite 60-sample speech excitation subframes $e_F(n)$ in each 240-sample speech frame, where n varies from 0 (the first sample) to 59 (the last sample) in each composite excitation subframe $e_F(n)$. Adaptive excitation parameter set $A_{CD}$ consists of pitch information that defines the periodic characteristics of the four speech excitation subframes $e_F(n)$ in the frame. Fixed excitation parameter set $F_{CD}$ is formed with pulse location amplitude and sign information which defines pulses that characterize the non-periodic components of the four excitation subframes $e_F(n)$.

Excitation generator 24 consists of an adaptive codebook decoder 36, a fixed codebook decoder 38, an adder 40, and a pitch post-filter 42. Using adaptive excitation parameters $A_{CD}$ as an address to an adaptive excitation codebook, adaptive codebook decoder 36 decodes parameter set $A_{CD}$ to produce four 60-sample adaptive excitation subframes $u_D(n)$ in each speech frame, where n varies from 0 to 59 in each adaptive excitation subframe $u_D(n)$. The adaptive excitation codebook is adaptive in that the entries in the codebook vary from subframe to subframe depending on the values of the samples that form prior adaptive excitation subframes $u_D(n)$ . Utilizing fixed excitation parameters $F_{CD}$ as an address to a fixed excitation codebook, fixed codebook decoder 38 decodes parameter set $F_{CD}$ to generate four 60-sample fixed excitation subframes $v_D(n)$ in each frame, where n similarly varies from 0 to 59 in each fixed excitation subframe $v_D(n)$.

Adaptive excitation subframes $u_D(n)$ provide the eventual periodic characteristics for composite excitation subframes $e_F(n)$, while fixed excitation subframes $v_D(n)$ provide the non-periodic pulse characteristics. By summing each adaptive excitation subframe $u_D(n)$ and the corresponding fixed excitation subframe $v_D(n)$ on a sample by sample basis, adder 40 produces a composite 60-sample decoded excitation speech subframe $e_D(n)$ as:

$$e_D(n)=u_D(n)+v_D(n)\ ,\ n=0,1,\ldots 59 \tag{1}$$

Pitch post-filter 42 generates 60-sample excitation subframes $e_F(n)$, where n runs from 0 to 59 in each subframe $e_F(n)$, by filtering decoded excitation subframes $e_D(n)$ to improve the communication quality of output speech samples y(n). The amount of computation power needed for the present coder can be reduced by deleting pitch post-filter 42. Doing so will not affect the interoperability of the coder with the G.723 coder.

Formant synthesis filter 26 is a time-varying recursive linear filter to which prediction coefficient vector $\tilde{A}_{Di}$ and composite excitation subframes $e_F(n)$ (or $e_D(n)$) are furnished for each subframe i. The ten quantized prediction coefficients $\{\tilde{a}_{ij}\}$ of each prediction coefficient vector $\tilde{A}_{Di}$, where j again runs from 1 to 10 in each subframe i, are used in characterizing formant synthesis filter 26 so as to model the human vocal tract. Excitation subframes $e_F(n)$ (or $e_D(n)$) model the glottal excitation produced as air passes the human vocal cords.

Using prediction vectors $\tilde{A}_{Di}$, formant synthesis filter 26 is defined for each subframe i by the following z transform $\tilde{A}_i(z)$ for a tenth-order recursive filter:

$$\tilde{A}_i(z) = \frac{1}{1 - \sum_{j=1}^{10} \tilde{a}_{ij} z^{-j}}, \quad 0 \leqq i \leqq 3 \tag{2}$$

Formant synthesis filter 26 filters incoming composite speech excitation subframes $e_F(n)$ (or $e_D(n)$) according to the synthesis filter represented by Eq. (2) to produce decompressed 240-sample synthesized digital speech frames $y_S(n)$, where n varies from 0 to 239 for each synthesized speech frame $y_S(n)$. Four consecutive excitation subframes $e_F(n)$ are used to produce each synthesized speech frame $y_S(n)$, with the ten prediction coefficients $\{\tilde{a}_{ij}\}$ being updated each 60-sample subframe i.

In equation form, synthesized speech frame $y_S(n)$ is given by the relationship:

$$y_s(n) = e_G(n) + \sum_{j=1}^{10} \tilde{a}_{ij} y_s(n-j), \; n = 0, 1, \ldots 239 \tag{3}$$

where $e_G(n)$ is a concatenation of the four consecutive subframes $e_F(n)$ (or $e_D(n)$) in each 240-sample speech frame. In this manner, synthesized speech waveform samples $y_S(n)$ approximate original uncompressed input speech waveform samples x(n).

Due to the compression applied to input speech samples x(n), synthesized output speech samples $y_S(n)$ typically differ from input samples x(n). The difference results in some perceptual distortion when synthesized samples $y_S(n)$ are converted to output speech sounds for persons to hear. The perceptual distortion is reduced by post processor 28 which generates further synthesized 240-sample digital speech frames $y_P(n)$ in response to synthesized speech frames $y_S(n)$ and the four prediction coefficient vectors $\tilde{A}_{Di}$ for each frame, where n runs from 0 to 239 for each post-processed speech frame $y_P(n)$. Post processor 28 consists of a formant post-filter 46 and a gain scaling unit 48.

Formant post-filter 46 filters decompressed speech frames $y_S(n)$ to produce 240-sample filtered digital synthesized speech frames $y_F(n)$, where n runs from 0 to 239 for each filtered frame $y_F(n)$. Post-filter 46 is a conventional autoregressive-and-moving-average linear filter whose filter characteristics depend on the ten coefficients $\{\tilde{a}_{ij}\}$ of each prediction coefficient vector $\tilde{A}_{Di}$ where j again runs from 1 to 10 for each subframe i.

In response to filtered speech frames $y_S(n)$, gain scaling unit 48 scales the gain of filtered speech frames $y_F(n)$ to generate decompressed speech frames $y_P(n)$. Gain scaling unit 48 equalizes the average energy of each decompressed speech frame $y_P(n)$ to that of filtered speech frame $y_S(n)$.

Post processor 28 can be deleted to reduce the amount of computation power needed in the present coder. As with deleting pitch post-filter 42, deleting post-processor 28 will not affect the interoperability of the coder with the G.723 coder.

Output buffer 30 stores each decompressed output speech frame $y_P(n)$ (or $y_S(n)$) for subsequent transmission to DAC 18 as decompressed output speech datastream y(n). This completes the decoder operation.

Decoder components 32, 34, 36, and 38, which duplicate corresponding components in digital speech encoder 12, preferably operate in the manner further described in paragraphs 3.2–3.5 of the July 1995 G.723 specification. Further details on the preferred implementations of decoder components 42, 26, 46, and 48 are given in paragraphs 3.6–3.9 of the G.723 specification.

With the foregoing in mind, the operation of digital speech encoder 12 can be readily understood. Encoder 12 employs linear predictive coding (again, "LPC") and an analysis-by-synthesis method to generate compressed digital speech datastream $x_C$ which, in the absence of storage or transmission errors, is identical to compressed digital speech datastream $y_C$ provided to decoder 16. The LPC and analysis-by-synthesis techniques used in encoder 12 basically entail:

a. Analyzing digital input speech samples x(n) to produce a set of quantized prediction coefficients that establish the numerical characteristics of a formant synthesis filter corresponding to formant synthesis filter 26, b. Establishing values for determining the excitation components of compressed datastream $x_C$ in accordance with information stored in excitation codebooks that duplicate excitation codebooks contained in decoder 16, c. Comparing parameters that represent input speech samples x(n) with corresponding approximated parameters generated by applying the excitation components of compressed datastream $x_C$ to the formant synthesis filter in encoder 12, and d. Choosing excitation parameter values which minimize the difference, in a perceptually weighted senses between the parameters that represent actual input speech samples x(n) and the parameters that represent synthesized speech samples. Because encoder 12 generates a formant synthesis filter that mimics formant filter 26 in decoder 16, certain of the components of decoder 16 are substantially duplicated in encoder 12.

Figure 3:
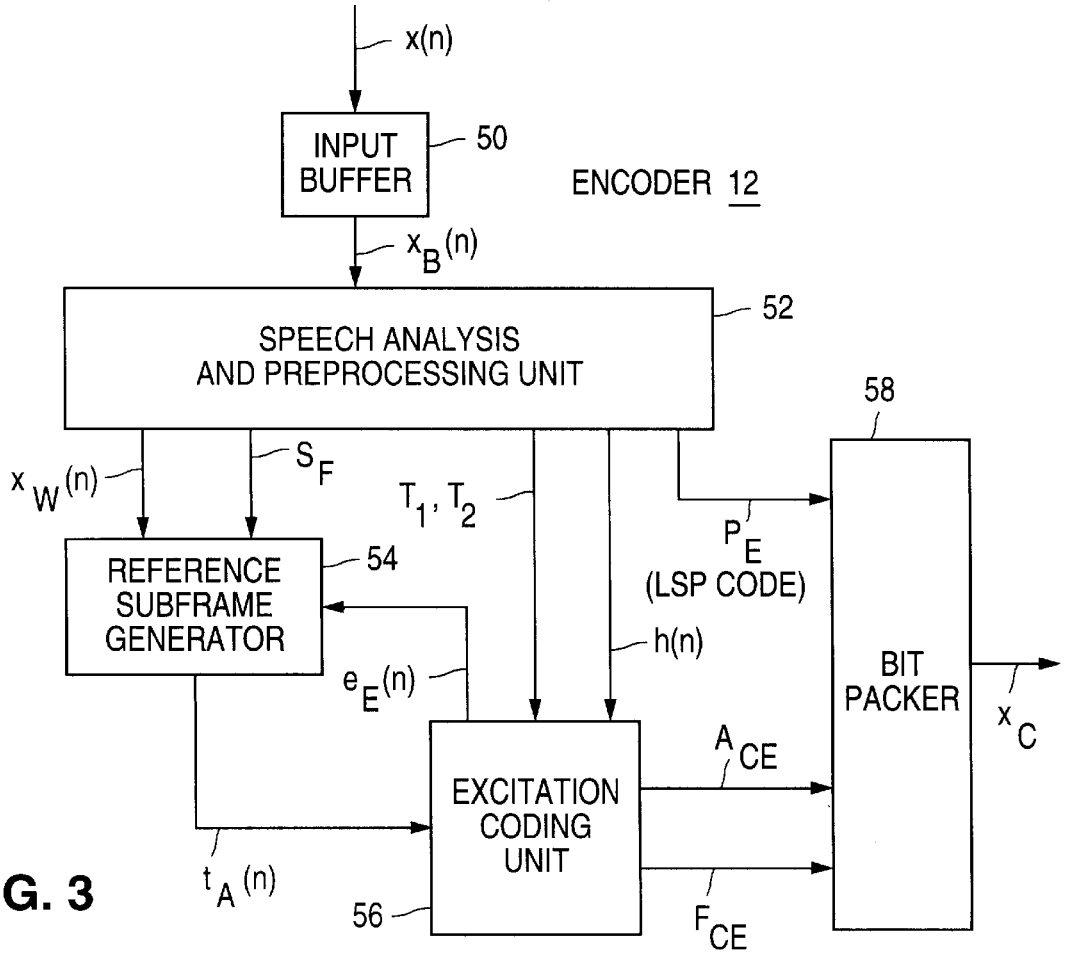
FIG. 3 is a block diagram of a digital speech encoder configured in accordance with the invention for use in the coder contained in the speech compression/decompression system of FIG. 1.

A high-level view of digital speech encoder 12 is shown in FIG. 3. Encoder 12 is constituted with an input framing buffer 50, a speech analysis and preprocessing unit 52, a reference subframe generator 54, an excitation coding unit 56, and a bit packer 58. The formant synthesis filter in encoder 12 is combined with other filters in encoder 12, and (unlike synthesis filter 26 in decoder 16) does not appear explicitly in any of the present block diagrams.

Input buffer 50 stores digital speech samples x(n) provided from ADC 10. When a frame of 240 samples of input speech datastream x(n) have been accumulated, buffer 50 furnishes input samples x(n) in the form of a 240-sample digital input speech frame $x_B(n)$.

Speech analysis and preprocessing unit 52 analyzes each input speech frame $x_B(n)$ and performs certain preprocessing steps on speech frame $x_B$ (n). In particular, analysis/preprocessing unit 52 conducts the following operations upon receiving input speech frame $x_B(n)$:

a. Remove any DC component from speech frame $x_B(n)$ to produce a 240-sample DC-removed input speech frame $x_F(n)$, b. Perform an LPC analysis on DC-removed input speech frame $x_F(n)$ to extract an unquantized prediction coefficient vector $A_E$ that is used in deriving various filter parameters employed in encoder 12, c. Convert unquantized prediction vector $A_E$ into an unquantized LSP vector $P_U$;

d. Quantize LSP vector $P_U$ and then convert the quantized LSP vector into an LSP code $P_E$, a 24-bit number, e. Compute parameter values for a formant perceptual weighting filter based on prediction vector $A_E$ extracted in operation b, f. Filter DC-removed input speech frame $x_F(n)$ using the formant perceptual weighting filter to produce a 240-sample perceptually weighted speech frame $x_P(n)$, g. Extract open-loop pitch periods $T_1$ and $T_2$, where $T_1$ is the estimated average pitch period for the first half frame (the first 120 samples) of each speech frame, and $T_2$ is the estimated average pitch period for the second half frame (the last 120 samples) of each speech frame, h. Compute parameter values for a harmonic noise shaping filter using pitch periods $T_1$ and $T_2$ extracted in operation g, i. Apply DC-removed speech frame $x_F(n)$ to a cascade of the perceptual weighting filter and the harmonic noise shaping filter to generate a 240-sample perceptually weighted speech frame $x_W(n)$, j. Construct a combined filter consisting of a cascade of the formant synthesis filter, the perceptual weighting filter, and the harmonic noise shaping filter, and k. Apply an impulse signal to the combined formant synthesis/perceptual weighting/harmonic noise shaping filter and, for each 60-sample subframe of DC-removed speech frame $x_F(n)$, keep the first 60 samples to form an impulse response subframe h(n).

In conducting the previous operations, analysis/preprocessing unit 52 generates the following output signals as indicated in FIG. 3: (a) open-loop pitch periods $T_1$ and $T_2$, (b) LSP code $P_E$, (c) perceptually weighted speech frame $x_W(n)$, (d) a set $S_F$ of parameter values used to characterize the combined formant synthesis/perceptual weighting/harmonic noise shaping filter, and (e) impulse response subframes h(n). Pitch periods $T_1$ and $T_2$ LSP code $P_E$, and weighted speech frame $x_W(n)$ are computed once each 240-sample speech frame. Combined-filter parameter values $S_F$ and impulse response h(n) are computed once each 60-sample subframe. In the absence of storage or transmission errors in storage unit/digital channel 14, LSP code $P_D$ supplied to decoder 16 is identical to LSP code $P_E$ generated by encoder 12.

Reference subframe generator 54 generates 60-sample reference (or target) subframes $t_A(n)$ in response to weighted speech frames $x_W(n)$, combined-filter parameter values $S_F$, and composite 60-sample excitation subframes $e_E(n)$. In generating reference subframes $t_A(n)$, subframe generator 54 performs the following operations:

a. Divide each weighted speech frame $x_W(n)$ into four 60-sample subframes, b. For each subframe, compute a 60-sample zero-input-response ("ZIR") subframe r(n) of the combined formant synthesis/perceptual weighting/harmonic noise shaping filter by feeding zero samples (i.e., input signals of zero value) to the combined filter and retaining the first 60 filtered output samples, c. For each subframe, generate reference subframe $t_A(n)$ by subtracting corresponding ZIR subframe r(n) from the appropriate quarter of weighted speech frame $x_W(n)$ on a sample by sample basis, and d. For each subframe, apply composite excitation subframe $e_E(n)$ to the combined formant synthesis/perceptual weighting/harmonic noise shaping filter and store the results so as to update the combined filter.

Pitch periods $T_1$ and $T_2$, impulse response subframes h(n), and reference subframes $t_A(n)$ are furnished to excitation coding unit 56. In response, coding unit 56 generates a set $A_{CE}$ of adaptive codebook excitation parameters for each 240-sample speech frame and a set $F_{CE}$ of fixed codebook excitation parameters for each frame. In the absence of storage or transmission errors in block 14, codebook excitation parameters $A_{CD}$ and $F_{CD}$ supplied to excitation generator 24 in decoder 16 are respectively the same as codebook excitation parameters $A_{CE}$ and $F_{CE}$ provided from excitation coding unit 56 in encoder 12. Coding unit 56 also generates composite excitation subframes $e_E(n)$.

Bit packer 58 combines LSP code $P_E$ and excitation parameter sets $A_{CE}$ and $F_{CE}$ to produce compressed digital speech datastream $x_C$. As a result of the foregoing operations, datastream $x_C$ is generated at either 5.3 kbps or 6.3 kbps depending on the desired application.

Compressed datastream $x_C$ is now furnished to storage unit/communication channel 14 for transmission to decoder 16 as compressed bitstream $y_C$. Since LSP code $P_E$ and excitation parameter gets $A_{CE}$ and $F_{CE}$ are combined to form datastream $x_C$, datastream $y_C$ is identical to datastream $x_C$, provided that no storage or transmission errors occur in block 14.

Figure 4:
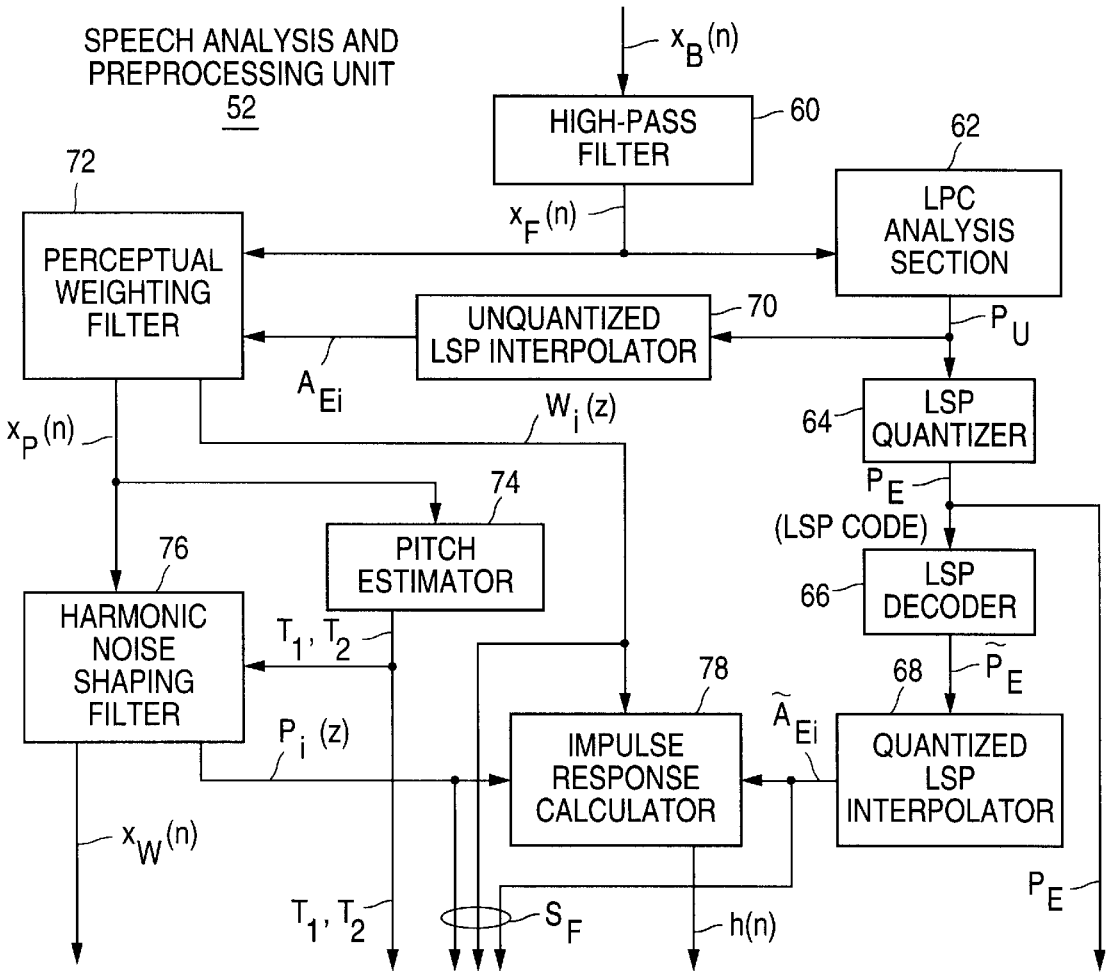
FIGS. 4, 5, and 6 are respective block diagrams of a speech analysis and preprocessing unit, a reference subframe generator, and an excitation coding unit employed in the encoder of FIG. 3.

FIG. 4 illustrates speech analysis and preprocessing unit 52 in more detail. Analysis/preprocessing unit 52 is formed with a high-pass filter 60, an LPC analysis section 62, an LSP quantizer 64, an LSP decoder 66, a quantized LSP interpolator 68, an unquantized LSP interpolator 70, a perceptual weighting filter 72, a pitch estimator 74, a harmonic noise shaping filter 76, and an impulse response calculator 78. Components 60, 66, 68, 72, 74, 76, and 78 preferably operate as described in paragraphs 2.3 and 2.5–2.12 of the July 1995 G.723 specification.

High-pass filter 60 removes the DC components from input speech frames $x_B(n)$ to produce DC-removed filtered speech frames $x_F(n)$ , where n varies from 0 to 239 for each input speech frame $x_B(n)$ and each filtered speech frame $x_F(n)$. Filter 60 has the following z transform H(z):

$$H(z) = \frac{1 - z^{-1}}{1 - \left(\frac{127}{128}\right) z^{-1}} \tag{4}$$

LPC analysis section 62 performs a linear predictive coding analysis on each filtered speech frame $x_F(n)$ to produce vector $A_E$ of ten unquantized prediction coefficients $\{a_j\}$ for the last subframe of filtered speech frame $x_F(n)$ , where j runs from 1 to 10. A tenth-order LPC analysis is utilized in which a window of 180 samples is centered on the last $x_F(n)$ subframe. A Hamming window is applied to the 180 samples. The ten unquantized coefficients $\{a_j\}$ of prediction coefficient vector $A_E$ are computed from the windowed signal.

LPC analysis section 62 then converts unquantized prediction coefficients $\{a_j\}$ to an unquantized LSP vector $P_U$ consisting of ten terms $\{p_j\}$, where j runs from 1 to 10. Unquantized LSP vector $P_U$ is furnished to LSP quantizer 64 and unquantized LSP interpolator 70.

Upon receiving LSP vector $P_U$, LSP quantizer 64 quantizes the ten unquantized terms $\{p_j\}$ and converts the quantized LSP data into LSP code $P_E$. The LSP quantization is performed once each 240-sample speech frame. LSP code $P_E$ is furnished to LSP decoder 66 and to bit packer 58.

LSP decoder 66 and quantized LSP interpolator 68 operate respectively the same as LSP decoder 32 and LSP interpolator 34 in decoder 16. In particular, components 66 and 68 convert LSP code $P_E$ into four quantized prediction coefficient vectors $\{\tilde{A}_{Ei}\}$, one for each subframe i of the current frame. Integer i again runs from 0 to 3. Each prediction coefficient vector $\tilde{A}_{Ei}$ consists of ten quantized prediction coefficients $\{\tilde{a}_{ij}\}$, where j runs from 1 to 10.

In generating each quantized prediction vector $\tilde{A}_{Ei}$, LSP decoder 66 first decodes LSP code $P_E$ to produce a quantized LSP vector $\tilde{P}_E$ consisting of ten quantized LSP terms $\{\tilde{p}_j\}$ for j running from 1 to 10. For each subframe i of the current speech frame, quantized LSP interpolator 68 linearly interpolates between quantized LSP vector $P_E$ of the current frame and quantized LSP vector $\tilde{P}_E$ of the previous frame to produce an interpolated LSP vector $\tilde{P}_{Ei}$ of ten quantized LSP terms $\{\tilde{p}_{ij}\}$, with j again running from 1 to 10. Four interpolated LSP vectors $\tilde{P}_{Ei}$ are thereby generated for each frame, where i runs from 0 to 3. Interpolator 68 then converts the four LSP vectors $\tilde{P}_{Ei}$ respectively into the four quantized prediction coefficient vectors $\tilde{A}_{Ei}$.

The formant synthesis filter in encoder 12 is defined according to Eq. 2 (above) using quantized prediction coefficients $\{\tilde{a}_{ij}\}$ . Due to the linear interpolation, the characteristics of the encoder's synthesis filter vary smoothly from subframe to subframe.

LSP interpolator 70 converts unquantized LSP vector $P_U$ into four unquantized prediction coefficient vectors $A_{Ei}$, where i runs from 0 to 3. One unquantized prediction coefficient vector $A_{Ei}$ is produced for each subframe i of the current frame. Each prediction coefficient vector $A_{Ei}$ consists of ten unquantized prediction coefficients $\{a_{ij}\}$, where j runs from 1 to 10.

In generating the four unquantized prediction coefficient vectors $A_{Ei}$, LSP interpolator 70 linearly interpolates between unquantized LSP vector $P_U$ of the current frame and unquantized LSP vector $P_U$ of the previous frame to generate four interpolated LSP vectors $P_{Ei}$, one for each subframe i. Integer i runs from 0 to 3. Each interpolated LSP vector $P_{Ei}$ consists of ten unquantized LSP terms $\{p_{ij}\}$ , where j runs from 1 to 10. Interpolator 70 then converts the four interpolated LSP vectors $P_{Ei}$ respectively into the four unquantized prediction coefficient vectors $A_{Ei}$.

Utilizing unquantized prediction coefficients $\{a_{ij}\}$, perceptual weighting filter 72 filters each DC-removed speech frame $x_F(n)$ to produce a perceptually weighted 240-sample speech frame $x_P(n)$ , where n runs from 0 to 239. Perceptual weighting filter 72 has the following z transform $W_i(z)$ for each subframe i in perceptually weighted speech frame $x_p(n)$:

$$W_i(z) = \frac{1 - \sum_{j=1}^{10} a_{ij} z^{-1} \gamma_1^j}{1 - \sum_{j=1}^{10} a_{ij} z^{-1} \gamma_2^j}, \quad 0 \leqq i \leqq 3 \tag{6}$$

where $\lambda_1$ is a constant equal to 0.9, and $\lambda_2$ is a constant equal to 0.5. Unquantized prediction coefficients $\{a_{ij}\}$ are updated every subframe i in generating perceptually weighted speech frame $x_p(n)$ for the full frame.

Pitch estimator 74 divides each perceptually weighted speech frame $x_p(n)$ into a first half frame (the first 120 samples) and a second half frame (the last 120 samples). Using the 120 samples in the first half frame, pitch estimator 74 computes an estimate for open-loop pitch period $T_1$. Estimator 74 similarly estimates open-loop pitch period $T_2$ using the 120 samples for the second half frame. Pitch periods $T_1$ and $T_2$ are generated by minimizing the energy of the open-loop prediction error in each perceptually weighted speech frame $x_p(n)$.

Harmonic noise shaping filter 76 applies harmonic noise shaping to each perceptually weighted speech frame $x_p(n)$ to produce a 240-sample weighted speech frame $x_W(n)$ for n equal to 0, 1, . . . 239. Harmonic noise shaping filter 76 has the following z transform $P_i(z)$ for each subframe i in weighted speech frame $x_w(n)$:

$$P_i(Z) = 1 - \beta_i z^{-L_i}, \quad 0 \leqq i \leqq 3 \tag{7}$$

where $L_i$ is the open-loop pitch lag, and $\beta_i$ is a noise shaping coefficient. Open-loop pitch lag $L_i$ and noise shaping coefficient $\beta_i$ are updated every subframe i in generating weighted speech frame $x_W(n)$. Parameters $L_i$ and $\beta_i$ are computed from the corresponding quarter of perceptually weighted speech frame $x_P(n)$.

Perceptual weighting filter 72 and harmonic noise shaping filter 76 work together to improve the communication quality of the speech represented by compressed datastream $x_C$. In particular, filters 72 and 76 take advantage of the non-uniform sensitivity of the human ear to noise in different frequency regions. Filters 72 and 76 reduce the energy of quantized noise in frequency regions where the speech energy is low while allowing more noise in frequency regions where the speech energy is high. To the human ear, the net effect is that the speech represented by compressed datastream $x_C$ is perceived to sound more like the speech represented by input speech waveform samples x(n) and thus by analog input speech signal x(t).

Perceptual weighting filter 72, harmonic noise shaping filter 76, and the encoder's formant synthesis filter together form the combined filter mentioned above. For each subframe i, impulse response calculator 78 computes the response h(n) of the combined formant synthesis/perceptual weighting/harmonic noise shaping filter to an impulse input signal $i_i(n)$ given as:

$$i_i(n) = \left\{ \begin{array}{l} 1, n = 0 \\ 0, n > 0 \end{array} \right\}, n = 0, 1, \ldots 59 \tag{8}$$

The combined filter has the following z transform $S_i(z)$ for each subframe i of impulse response subframe h(n):

$$S_i(z) = \tilde{A}_i(z) W_i(z) P_i(z), \quad 0 \leqq i \leqq 3 \tag{9}$$

where transform components $\tilde{A}_i(z)$ , $W_i(z)$ , and $P_i(z)$ are given by Eqs. 2, 6, and 7. The numerical parameters of the combined filter are updated each subframe i in impulse response calculator 78.

In FIG. 4, reference symbols $W_i(z)$ and $P_i(z)$ are employed, for convenience, to indicate the signals which convey the filtering characteristics of filters 72 and 76. These signals and the four quantized prediction vectors $\tilde{A}_{Ei}$ together form combined filter parameter set $S_F$ for each speech frame.

Figure 5:
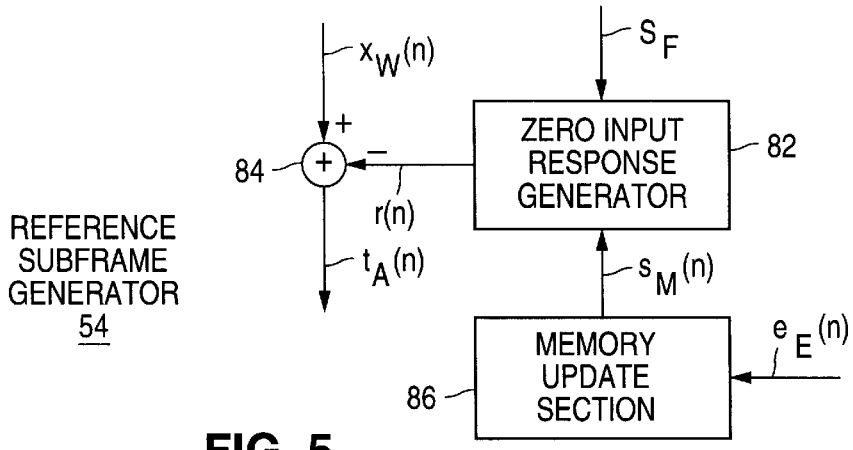

Reference subframe generator 54 is depicted in FIG. 5. Subframe generator 54 consists of a zero input response generator 82, a subtractor 84, and a memory update section 86. Components 82, 84, and 86 are preferably implemented as described in paragraphs 2.13 and 2.19 of the July 1995 G.723 specification.

The response of a filter can be divided into a zero input response ("ZIR") portion and a zero state response ("ZSR") portion. The ZIR portion is the response that occurs when input samples of zero value are provided to the filter. The ZIR portion varies with the contents of the filter's memory (prior speech information here). The ZSR portion is the response that occurs when the filter is excited but has no memory. The sum of the ZIR and ZSR portions constitutes the filter's full response.

For each subframe i, ZIR generator 82 computes a 60-sample zero input response subframe r(n) of the combined formant synthesis/perceptual weighting/harmonic noise shaping filter represented by z transform $S_i(z)$ of Eq. 9, where n varies from 0 to 59 . Subtractor 84 subtracts each ZIR subframe r(n) from the corresponding quarter of weighted speech frame $x_W(n)$ on a sample by sample basis to produce a 60-sample reference subframe $t_A(n)$ according to the relationship:

$$t_A(n)=x_W(60i+n)-r(n) \tag{10}$$

Since the full response of the combined formant synthesis/perceptual weighting/harmonic noise shaping filter for each subframe i is the sum of the ZIR and ZSR portions for each subframe i, reference subframe $t_A(n)$ is a target ZSR subframe of the combined filter.

After target ZSR subframe $t_A(n)$ is calculated for each subframe and before going to the next subframe, memory update section 86 updates the memories of the component filters in the combined $S_i(z)$ filter. Update section 86 accomplishes this task by inputting 60-sample composite excitation subframes $e_E(n)$ to the combined filter and then supplying the so-computed memory information $S_M(n)$ of the filter response to ZIR generator 82 for the next subframe.

Figure 6:
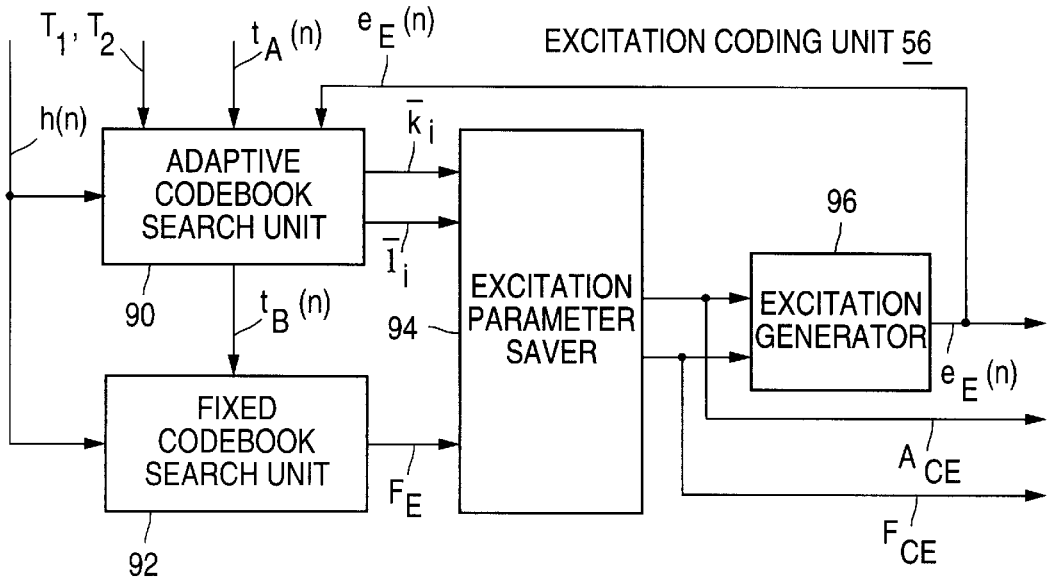

Excitation coding unit 56 computes each 60-sample composite excitation subframe $e_E(n)$ as the sum of a 60-sample adaptive excitation subframe $u_E(n)$ and a 60-sample fixed excitation subframe $v_E(n)$ in the manner described further below in connection with FIG. 9. Adaptive excitation subframes $u_E(n)$ are related to the periodicity of input speech waveform samples x(n), while fixed excitation subframes $v_E(n)$ are related to the non-periodic constituents of input speech samples x(n). Coding unit 56, as shown in FIG. 6, consists of an adaptive codebook search unit 90, a fixed codebook search unit 92, an excitation parameter saver 94, and an excitation generator 96.

Impulse response subframes h(n), target ZSR subframes $t_A(n)$, and excitation subframes $e_E(n)$ are furnished to adaptive codebook search unit 90. Upon receiving this information, adaptive codebook search unit 90 utilizes open-loop pitch periods $T_1$ and $T_2$ in looking through codebooks in search unit 90 to find, for each subframe i, an optimal closed-loop pitch period $\bar{l}_i$ and a corresponding optimal integer index $\bar{k}_i$ of a pitch coefficient vector, where i runs from 0 to 3. For each subframe i, optimal closed-loop pitch period $\bar{l}_i$ and corresponding optimal pitch coefficient $\bar{k}_i$ are later employed in generating corresponding adaptive excitation subframe $u_E(n)$. Search unit 90 also calculates 60-sample further reference subframes $t_B(n)$, where n varies from 0 to 59 for each reference subframe $t_B(n)$.

Fixed codebook search unit 92 processes reference subframes $t_B(n)$ to generate a set $F_E$ of parameter values representing fixed excitation subframes $v_E(n)$ for each speech frame. Impulse response subframes h(n) are also utilized in generating fixed excitation parameter set $F_E$.

Excitation parameter saver 94 temporarily stores parameters $\bar{k}_i$, $\bar{l}_i$, and $F_E$. At an appropriate time, parameter saver 94 outputs the stored parameters in the form of parameter sets $A_{CE}$ and $F_{CE}$. For each speech frame, parameter set $A_{CE}$ is a combination of four optimal pitch periods $\bar{l}_i$ and four optimal pitch coefficient indices $\bar{k}_i$, where i runs from 0 to 3. Parameter set $F_{CE}$ is the stored value of parameter set $F_E$. Parameter sets $A_{CE}$ and $F_{CE}$ are provided to bit packer 58.

Excitation generator 96 converts adaptive excitation parameter set $A_{CE}$ into adaptive excitation subframes $u_E(n)$ (not shown in FIG. 6), where n equals 0 , 1, . . . 59 for each subframe $u_E(n)$ . Fixed excitation parameter set $F_{CE}$ is similarly converted by excitation generator 96 into fixed excitation subframes $v_E(n)$ (also not shown in FIG. 6), where n similarly equals 0, 1, . . . 59 for each subframe $v_E(n)$ .Excitation generator 96 combines each pair of corresponding subframes $u_E(n)$ and $v_E(n)$ to generate composite excitation subframe $e_E(n)$ as described below. In addition to being fed back to adaptive codebook search unit 90, excitation subframes $e_E(n)$ are furnished to memory update section 86 in reference subframe generator 54.

Figure 7:
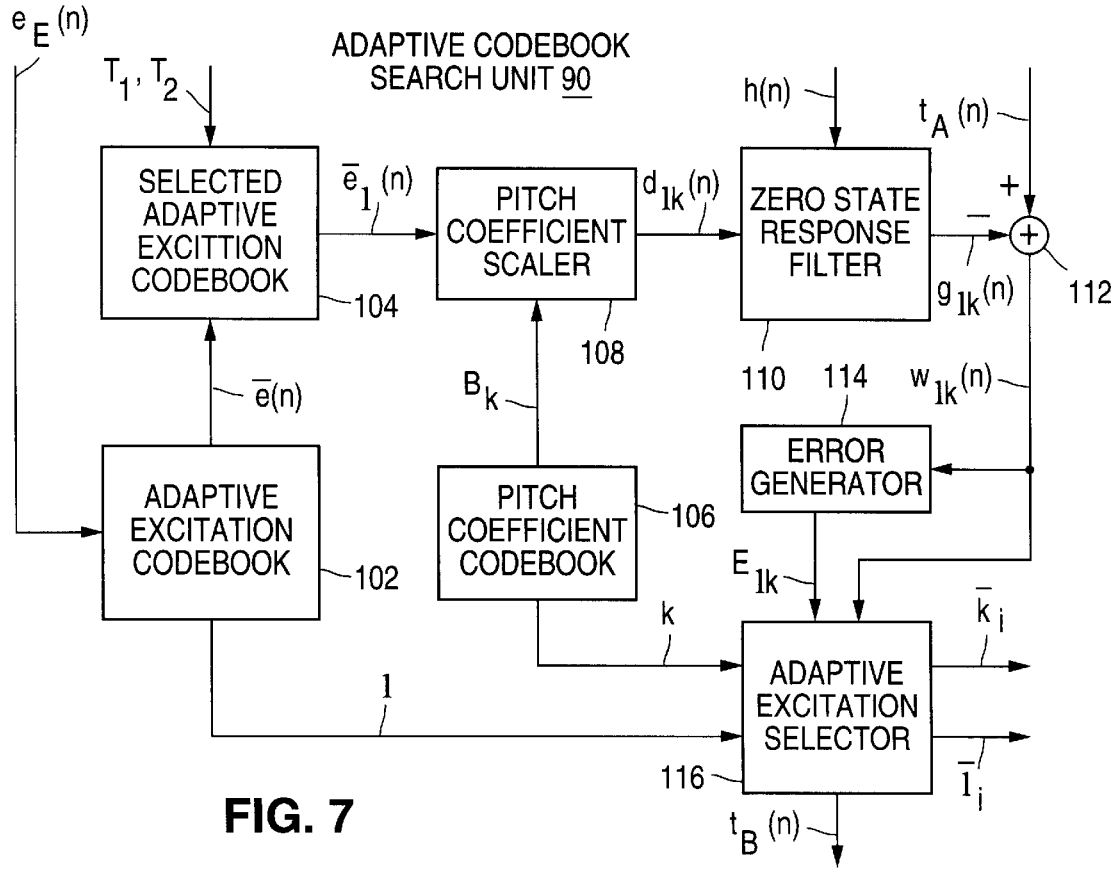
FIGS. 7, 8, and 9 are respective block diagrams of an adaptive codebook search unit, a fixed codebook search unit, and an excitation generator employed in the excitation coding unit of FIG. 6.

The internal configuration of adaptive codebook search unit 90 is depicted in FIG. 7. Search unit 90 contains three codebooks: an adaptive excitation codebook 102, a selected adaptive excitation codebook 104, and a pitch coefficient codebook 106. The remaining components of search unit 90 are a pitch coefficient scaler 108, a zero state response filter 110, a subtractor 112, an error generator 114, and an adaptive excitation selector 116.

Adaptive excitation codebook 102 stores the N immediately previous $e_E(n)$ samples. That is, letting the time index for the first sample of the current speech subframe be represented by a zero value for n, adaptive excitation codebook 102 contains excitation samples e(−N), e(−N+1), . . . e(−1). The number N of excitation samples e(n) stored in adaptive excitation codebook 102 is set at a value that exceeds the maximum pitch period. As determined by speech research, N is typically 145–150 and preferably is 145. Excitation samples e(−N)–e(−1) are retained from the three immediately previous excitation subframes $e_E(n)$ for n running from 0 to 59 in each of those $e_E(n)$ subframes. Reference symbol $\bar{e}(n)$ in FIG. 7 is utilized to indicate e(n) samples read out from codebook 102, where n runs from 0 to 63.

Selected adaptive excitation codebook 104 contains several, typically two to four, candidate adaptive excitation vectors $\bar{e}_l(n)$ created from e(n) samples stored in adaptive excitation codebook 102. Each candidate adaptive excitation vector $\bar{e}_l$ contains 64 samples $\bar{e}_l(0)$, $\bar{e}_l(1)$, . . . $\bar{e}_l(63)$ and therefore is slightly wider than excitation subframe $e_E(n)$. An integer pitch period l is associated with each candidate adaptive excitation vector $\bar{e}_l(n)$. Specifically, each candidate vector $\bar{e}_l(n)$ is given as:

$$\begin{aligned} &\bar{e}_l(0)=e(-2-l) \\ &\bar{e}_l(1)=e(-1-l) \\ &\bar{e}_l(n)=e([n \bmod l]-l),\ 2\leqq n\leqq 63 \end{aligned} \tag{11}$$

where "mod" is the modulus operation in which n mod 1 is the remainder (if any) that arises when n is divided by 1.

Candidate adaptive excitation vectors $\bar{e}_l(n)$ are determined according to their integer pitch periods l. When the present coder is operated at the 6.3-kbps rate, candidate values of pitch period l are given in Table 1 as a function of subframe number i provided that the indicated condition is met:

TABLE 1

| Subframe Number | Condition | Candidates for pitch period 1 |
|---|---|---|
| 0 | $T_1 < 58$ | $T_1 - 1, T_1, T_1 + 1$ |
| 1 | $\bar{1}_0 < 57$ | $\bar{1}_0 - 1, \bar{1}_0, \bar{1}_0 + 1, 1_0 + 2$ |
| 2 | $T_2 < 58$ | $T_2 - 1, T_2, T_2 + 1$ |
| 3 | $\bar{1}_2 < 57$ | $\bar{1}_2 - 1, \bar{1}_2, \bar{1}_2 + 1, \bar{1}_2 + 2$ |

If the condition given in Table 1 for each subframe i is not met when the coder is operated at the 6.3-kbps rate, the candidate values of integer pitch period l are given in Table 2 as a function of subframe number i dependent on the indicated condition:

TABLE 2

| Subframe | Condition | | Candidates for pitch |
|---|---|---|---|
| Number | A | B | period 1 |
| 0 | $T_1 > 57$ | | $T_1 - 1, T_1, T_1 + 1$ |
| 1 | $\bar{1}_0 > 56$ and $\bar{1}_0 < T_1$ | | $\bar{1}_0 - 1, \bar{1}_0$ |
| 1 | $1_0 > 56$ and $\bar{1}_0 < T_1$ | | $1_0, \bar{1}_0 + 1$ |
| 2 | $T_2 > 57$ | | $T_2 - 1, T_2, T_2 + 1$ |
| 3 | $\bar{1}_2 > 56$ and $\bar{1}_2 \geqq T_2$ | | $\bar{1}_2 - 1, \bar{1}_2$ |
| 3 | $\bar{1}_2 > 56$ and $\bar{1}_2 < T_2$ | | $\bar{1}_2, \bar{1}_2 + 1$ |

In Table 2, each condition consists of a condition A and, for subframes 1 and 3, a condition B. When condition B is present, both conditions A and B must be met to determine the candidate values of pitch period l.

A comparison of Tables 1 and 2 indicates that the candidate values of pitch period l for subframe 0 in Table 2 are the same as in Table 1. For subframe 0 in Tables 1 and 2, meeting the appropriate condition $T_l<58$ or $T_2>57$ does not affect the selection of the candidate pitch periods. Likewise, the candidate values of pitch period l for subframe 2 in Table 2 are the same as in Table 1. Meeting the condition $T_2<58$ or $T_2>57$ for subframe 2 in Tables 1 and 2 does not affect the selection of the candidate pitch periods. However, as discussed below, optimal pitch coefficient index $\bar{k}_i$ for each subframe i is selected from one of two different tables of pitch coefficient indices dependent on whether Table 1 or Table 2 is utilized. The conditions prescribed for each of the subframes, including subframes 0 and 2, thus affect the determination of pitch coefficient indices $\bar{k}_i$ for all four subframes.

When the present coder is operated at the 5.3-kbps rate, the candidate values for integer pitch period l as a function of subframe i are determined from Table 2 dependent only on conditions B (i.e., the condition relating $\bar{1}_0$ to $T_1$ for subframe 1 and the condition relating $\bar{1}_2$ to $T_2$ for subframe 3). Conditions A in Table 2 are not used in determining candidate pitch periods when the coder is operated at the 5.3-kbps rate.

In Tables 1 and 2, $T_1$ and $T_2$ are the open-loop pitch periods provided to selected adaptive excitation codebook 104 from speech analysis and preprocessing unit 52 for the first and second half frames. Item $\bar{1}_0$, utilized for subframe 1, is the optimal closed-loop pitch period of subframe 0. Item $\bar{1}_2$, employed for subframe 3, is the optimal closed-loop pitch period of subframe 2. Optimal closed-loop pitch periods $\bar{1}_0$ and $\bar{1}_2$ are computed respectively during subframes 0 and 2 of each frame in the manner further described below and are therefore respectively available for use in subframes 1 and 3.

As shown in Tables 1 and 2, the candidate values for pitch period l for the first and third subframes are respectively generally centered around open-loop pitch periods $T_1$ and $T_2$. The candidate values of pitch period l for the second and fourth subframes are respectively centered around optimal closed-loop pitch periods $\bar{1}_0$ and $\bar{1}_2$ of the immediately previous (first and third) subframes. Importantly, the candidate pitch periods in Table 2 are a subset of those in Table 1 for subframes 1 and 3.

The G.723 decoder uses Table 1 for both the 5.3-kbps and the 6.3-kbps data rates. The amount of computation needed to generate compressed speech datastream $x_C$ depends on the number of candidate pitch periods l that must be examined. Table 2 restricts the number of candidate pitch periods more than Table 1. Accordingly, less computation is needed when Table 2 is utilized. Since Table 2 is always used for the 5.3-kbps rate in the present coder and is also inevitably used during part of the speech processing at the 6.3-kbps rate in the coder of the invention, the computations involving the candidate pitch periods in the present coder require less, typically 20% less, computation power than in the G.723 coder.

Pitch coefficient codebook 106 contains two tables (or subcodebooks) of preselected pitch coefficient vectors $B_k$, where k is an integer pitch coefficient index. Each pitch coefficient vector $B_k$ contains five pitch coefficients $b_{k0}, b_{k1}, \ldots b_{k4}$.

One of the tables of pitch coefficient vectors $B_k$ contains 85 entries. The other table of pitch coefficients vectors $B_k$ contains 170 entries. Pitch coefficient index k thus runs from 0 to 84 for the 85-entry group and from 0 to 169 for the 170-entry group. The 85-entry table is utilized when the candidate values of pitch period l are selected from Table 1—i.e., when the present coder is operated at the 6.3-kbps rate with the indicated conditions in Table 1 being met. The 170-entry table is utilized when the candidate values of pitch period l are selected from Table 2—i.e., (a) when the coder is operated at the 5.3-kbps rate and (b) when the coder is operated at the 6.3-kbps rate with the indicated conditions in Table 2 being met.

Components 108, 110, 112, 114, and 116 of adaptive codebook search unit 90 utilize codebooks 102, 104 and 106 in the following manner. For each pitch coefficient index k and for each candidate adaptive excitation vector $\bar{e}_l(n)$, where n varies from 0 to 63, that corresponds to a candidate integer pitch period l, pitch coefficient scaler 108 generates a candidate scaled subframe $d_{lk}(n)$ for which n varies from 0 to 59. Each candidate scaled subframe $d_{lk}(n)$ is computed as:

$$d_{lk}(n) = \sum_{j=0}^{4} b_{kj}\bar{e}_l(n+j) \tag{12}$$

Coefficients $b_{k0}$–$b_{k4}$ are the coefficients of pitch coefficient vector $B_k$ provided from the 85-entry or 170-entry table in pitch coefficient codebook 106 depending on whether the candidate values of pitch period l are determined from Table 1 or Table 2. Since there are either 85 or 170 values of pitch coefficient index k and since there are several candidate adaptive excitation vectors $\bar{e}_l$ for each subframe i so that there are several corresponding candidate pitch periods l for each subframe i, a relatively large number (over a hundred) of candidate scaled subframes $d_{lk}(n)$ are calculated for each subframe i.

ZSR filter 110 provides the zero state response for the combined formant synthesis/perceptual weighting/harmonic noise shaping filter represented by z transform $S_i(z)$ of Eq. 9. Using impulse response subframe h(n) provided from speech analysis and preprocessing unit 52, ZSR filter 110 filters each scaled subframe $d_{lk}(n)$ to produce a corresponding 60-sample candidate filtered subframe $g_{lk}(n)$ for n running from 0 to 59. Each filtered subframe $g_{lk}(n)$ is given as:

$$g_{lk}(n) = \sum_{j=0}^{n} d_{lj}(j)h(n-j) \tag{13}$$

Each filtered subframe $g_{lk}(n)$, referred to as a candidate adaptive excitation ZSR subframe, is the ZSR subframe of the combined filter as excited by the adaptive excitation subframe associated with pitch period l and pitch coefficient index k. As such, each candidate adaptive excitation ZSR subframe $g_{lk}(n)$ is approximately the periodic component of the ZSR subframe of the combined filter for those l and k values. Inasmuch as each subframe i has several candidate pitch periods l and either 85 or 170 numbers for pitch coefficient index k, a relatively large number of candidate adaptive excitation ZSR subframes $g_{lk}(n)$ are computed for each subframe i.

Subtractor 112 subtracts each candidate adaptive excitation ZSR subframe $g_{lk}(n)$ from target ZSR subframe $t_A(n)$ on a sample by sample basis to produce a corresponding 60-sample candidate difference subframe $w_{lk}(n)$ as:

$$w_{lk}(n)=t_A(n)-g_{lk}(n),\ n=0,1,\ldots 59 \tag{14}$$

As with subframes $d_{lk}(n)$ and $g_{lk}(n)$, a relatively large number of difference subframes $w_{lk}(n)$ are calculated for each subframe i.

Upon receiving each candidate difference subframe $w_{lk}(n)$, error generator 114 computes the corresponding squared error (or energy) $E_{lk}$ according to the relationship:

$$E_{lk} = \sum_{n=0}^{59} [w_{lk}(n)]^2 \tag{15}$$

The computation of squared error $E_{lk}$ is performed for each candidate adaptive excitation vector $e_l(n)$ stored in selected adaptive excitation codebook 104 and for each pitch coefficient vector $B_k$ stored either in the 85-entry table of pitch coefficient codebook 106 or in the 170-entry table of coefficient codebook 106 dependent on the data transfer rate and, for the 6.3-kbps rate, the pitch conditions given in Tables 1 and 2

The computed values of squared error $E_{lk}$ are furnished to adaptive excitation selector 116. The associated values of integer pitch period l and pitch coefficient index k are also provided from codebooks 102 and 106 to excitation selector 116 for each subframe i, where i varies from 0 to 3. In response, selector 116 selects optimal closed-loop pitch period $\bar{l}_i$ and pitch coefficient index $\bar{k}_i$ for each subframe i such that squared error (or energy) $E_{\bar{l}\bar{k}}$ has the minimum value of all squared error terms $E_{lk}$ computed for that subframe i. Optimal pitch period $\bar{l}_i$ and optimal pitch coefficient index $\bar{k}_i$ are provided as outputs from selector 116.

From among the candidate difference subframes $w_{lk}(n)$ supplied to selector 116, optimal difference subframe $w_{\bar{l}\bar{k}}(n)$ corresponding to selected pitch period $\bar{l}_i$ and selected pitch index coefficient $\bar{k}_i$ for each subframe i is provided from selector 116 as further reference subframe $t_B(n)$ . Turning briefly back to candidate adaptive excitation ZSR subframes $g_{lk}(n)$, subframe $g_{\bar{l}\bar{k}}(n)$ corresponding to optimal difference subframe $w_{\bar{l}\bar{k}}$ and thus to reference subframe $t_B(n)$ is the optimal adaptive excitation subframe. As mentioned above, each ZSR subframe $g_{lk}$ is approximately a periodic ZSR subframe of the combined formant synthesis/perceptual weighting/harmonic noise shaping filter for associated pitch period l and pitch coefficient index k. A full subframe can be approximated as the sum of a periodic portion and a non-periodic portion. Reference subframe $t_B(n)$ referred to as the target fixed excitation ZSR subframe, is thus approximately the optimal non-periodic ZSR subframe of the combined filter.

As discussed in more detail below, excitation generator 96 looks up each adaptive excitation subframe $u_E(n)$ based on adaptive excitation parameter set $A_{CE}$ which contains parameters $\bar{l}_i$ and $\bar{k}_i$, i again varying from 0 to 3. By generating parameters $\bar{l}_i$ and $\bar{k}_i$, adaptive codebook search unit 90 provides information in the same format as the adaptive codebook search unit in the G.723 coder, thereby permitting the present coder to be interoperable with the G.723 coder. Importantly, search unit 90 in the present coder determines the $\bar{l}_i$ and $\bar{k}_i$ information using less computation power than employed in the G.723 adaptive search codebook unit to generate such information.

Fixed codebook search unit 92 employs a maximizing correlation technique for generating fixed codebook parameter set $F_E$. The correlation technique requires less computation power, typically 90% less, than the energy error minimization technique used in the G.723 encoder to generate information for calculating a fixed excitation subframe corresponding to subframe $v_E(n)$. The correlation technique employed in search unit 92 of the present coder yields substantially optimal characteristics for fixed excitation subframes $v_E(n)$. Also, the information furnished by search unit 92 is in the same format as the information used to generate fixed excitation subframes in the G.723 encoder so as to permit the present coder to be interoperable with the G.723 coder.

Each fixed excitation subframe $v_E(n)$ contains M excitation pulses (non-zero values), where M is a predefined integer. When the present coder is operated at the 6.3-kbps rate, the number M of pulses is 6 for the even subframes (0 and 2) and 5 for the odd subframes (1 and 3). The number M of pulses is 4 for all the subframes when the coder is operated at the 5.3-kbps rate. Each fixed excitation subframe $v_E(n)$ thus contains five or six pulses at the 6.3-kbps rate and four pulses at the 5.3-kbps rate.

In equation form, each fixed excitation subframe $v_E(n)$ is given as:

$$v_E(n) = G \sum_{j=1}^{M} s_j\delta(n-m_j),\ n=0,1,\ldots 59 \tag{16}$$

where G is the quantized gain of fixed excitation subframe $v_E(n)$, $m_j$ represents the integer position of the j-th excitation pulse in fixed excitation subframe $v_E(n)$ , $s_j$ represents the sign (+1 for positive sign and −1 for negative sign) of the j-th pulse, and $\delta(n-m_j)$ is a Dirac delta function given as:

$$\delta(n-m_j) = \left\{ \begin{array}{l} 1,\ n=m_j \\ 0,\ n\neq m_j \end{array} \right\} \tag{17}$$

Each integer pulse position $m_j$ is selected from a set $K_j$ of predefined integer pulse positions. These $K_j$ positions are established in the July 1995 G.723 specification for both the 5.3-kbps and 6.3-kbps data rates as j ranges from 1 to M.

Fixed codebook search unit 92 utilizes the maximizing correlation technique of the invention to determine pulse positions $m_j$ and pulse signs $s_j$ for each optimal fixed excitation subframe $v_E(n)$, where j ranges from 1 to M. Unlike the G.723 encoder where the criteria for selecting fixed excitation parameters is based on minimizing the energy of the error between a target fixed excitation ZSR subframe and a normalized fixed excitation synthesized subframe, the criteria for selecting fixed excitation parameters in search unit 92 is based on maximizing the correlation between each target fixed excitation ZSR subframe $t_B(n)$ and a corresponding 60-sample normalized fixed excitation synthesized subframe, denoted here as q(n), for n running from 0 to 59.

The correlation C between target fixed excitation ZSR subframe $t_B(n)$ and corresponding normalized fixed excitation synthesized ZSR subframe q(n) is computed numerically as:

$$C = \sum_{n=0}^{59} t_B(n)q(n) \tag{18}$$

Normalized fixed excitation ZSR subframe q(n) depends on the positions $m_j$ and signs $s_j$ of the excitation pulses available to form fixed excitation subframe $v_E(n)$ for j equal to 0, 1, . . . M. Fixed codebook search unit 92 selects pulse positions $m_j$ and pulse signs $s_j$ in such a manner as to cause correlation C in Eq. 18 to reach a maximum value for each subframe i.

In accordance with the teachings of the invention, the form of Eq. 18 is modified to simplify the correlation calculations. Firstly, a normalized version c(n) of fixed excitation subframe $v_E(n)$, without gain scaling, is defined as follows:

$$c(n) = \sum_{j=1}^{M} s_j\delta(n - m_j),\ n = 0, 1, \ldots 59 \tag{19}$$

Normalized fixed excitation synthesized subframe q(n) is computed by performing a linear convolution between normalized fixed excitation subframe c(n) and corresponding impulse response subframe h(n) of the combined formant synthesis/perceptual weighting/harmonic noise shaping filter as given below:

$$q(n) = \sum_{j=0}^{n} c(j)h(n - j),\ n = 0, 1, \ldots 59 \tag{20}$$

For each 60-sample subframe, normalized fixed excitation ZSR subframe q(n) thus constitutes a ZSR subframe produced by feeding an excitation subframe into the combined filter as represented by its impulse response subframe h(n).

Upon substituting normalized fixed excitation ZSR subframe q(n) of Eq. 20 into Eq. 18, correlation C can be expressed as:

$$C = \sum_{n=0}^{59} f(n)c(n) \tag{21}$$

where f(n) is an inverse-filtered subframe for n running from 0 to 59. Inverse-filtered subframe is computed by inverse filtering target fixed excitation ZSR subframe $t_B(n)$ according to the relationship:

$$f(n) = \sum_{j=n}^{59} t_B(j)h(j - n),\ n = 0, 1, \ldots 59 \tag{22}$$

Substitution of normalized fixed excitation subframe c(n) of Eq. 19 into Eq. 21 leads to the following expression for correlation C:

$$C = \sum_{j=1}^{M} f(m_j)s_j \tag{23}$$

Further simplification of Eq. 23 entails choosing the sign $s_j$ of the pulse at each location $m_j$ to be equal to the sign of corresponding inverse-filtered sample $f(m_j)$. Correlation C is then expressed as:

$$C = \sum_{j=1}^{M} |f(m_j)| \tag{24}$$

where $|f(m_j)|$ is the absolute value of filtered sample f $(m_j)$

Maximizing correlation C in Eq. 24 is equivalent to maximizing each of the individual terms of the summation expression in Eq. 24. The maximum value maxC of correlation C is then given as:

$$\max C = \max\left[\sum_{j=1}^{M} |f(m_j)|\right] = \sum_{j=1}^{M} \max|f(m_j)| \tag{25}$$

Consequently, the optimal pulse positions $m_j$, for j running from 1 to M, can be found for each subframe i by choosing each pulse location $m_j$ from the corresponding set $k_j$ of predefined locations such that inverse-filtered sample magnitude $|f(m_j)|$ is maximized for that pulse position $m_j$.

Figure 8:
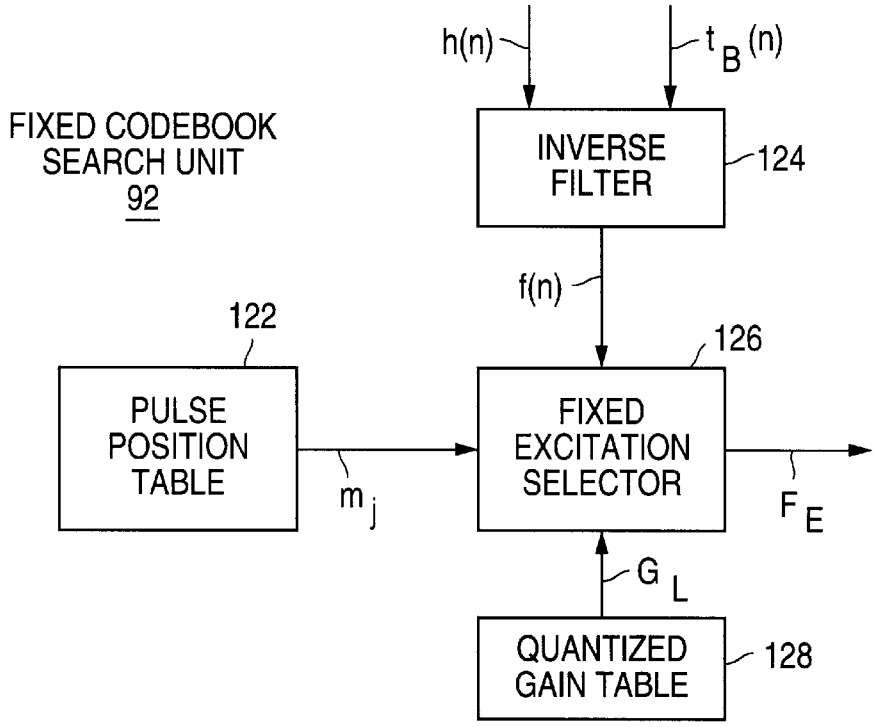

Fixed codebook search unit 92 implements the foregoing technique for maximizing the correlation between target fixed excitation ZSR subframe $t_B(n)$ and corresponding normalized fixed excitation synthesized ZSR subframe q(n). The internal configuration of search unit 92 is shown in FIG. 8. Search unit 92 consists of a pulse position table 122, an inverse filter 124, a fixed excitation selector 126, and a quantized gain table 128.

Pulse position table 122 stores the sets $K_j$ of pulse positions $m_j$ where j ranges from 1 to M for each of the two data transfer rates. Since M is 5 or 6 when the coder is operated at the 6.3-kbps rate, position table 122 contains six pulse position sets $K_1$, $K_2$, . . . $K_6$ for the 6.3-kbps rate. Position table 122 contains four pulse position sets $K_1$, $K_2$, $K_3$, and $K_4$ for the 5.3-kbps rate, where pulse position sets $K_1$ –$K_4$ for the 5.3-kbps rate variously differ from pulse position sets $K_1$ –$K_4$ for the 6.3-kbps rate.

Impulse response subframe h(n) and corresponding target fixed excitation ZSR subframe $t_B(n)$ are furnished to inverse filter 124 for each subframe i. Using impulse response subframe h(n) to define the inverse filter characteristics, filter 124 inverse filters corresponding reference subframe $t_B(n)$ to produce a 60-sample inverse-filtered subframe f(n) according to Eq. 22 given above.

Upon receiving inverse-filtered subframe f(n), fixed excitation selector 126 determines the optimal set of M pulse locations $m_j$, selected from pulse position table 122, by performing the following operations for each value of integer j in the range of 1 to M:

a. Search for the value of n that yields the maximum absolute value of filtered sample f(n). Pulse position $m_j$ is set to this value of n provided that it is one of the pulse locations in pulse position set $K_j$. The search operation is expressed mathematically as:

$$m_j = argmax[|f(n)|],\ n \subset K_j \tag{26}$$

b. After n is so found and pulse position $m_j$ is set equal to n, filtered sample $f(m_j)$ is set to a negative value, typically –1, to prevent that pulse position $m_j$ from being selected again.

When the preceding operations are completed for each value of j from 1 to M, pulse positions $m_j$ of all M pulses for fixed excitation subframe $v_E(n)$ have been established. Operations a and b in combination with the inverse filtering provided by filter 124 maximize the correlation between target fixed excitation ZSR subframe $t_B(n)$ and normalized fixed excitation synthesized ZSR subframe q(n) in determining the pulse locations for each subframe i. The amount of computation needed to perform this correlation is, as indicated above, less than that utilized in the G.723 encoder to determine the pulse locations.

Fixed excitation selector 126 determines pulse sign $s_j$ of each pulse as the sign of filtered sample $f(m_j)$ according to the relationship:

$$s_j = sign[f(m_j)],\ j=1, 2, \ldots M \tag{27}$$

Excitation selector 126 determines the unquantized excitation gain $\overline{G}$ by a calculation procedure in which Eq. 19 is first utilized to compute an optimal version $\overline{c}(n)$ of normalized fixed excitation subframe c(n) where pulse positions $m_j$ and pulse signs $s_j$ are the optimal pulse locations and signs as determined above for j running from 1 to M. An optimal version $\overline{q}(n)$ of normalized fixed excitation ZSR subframe q(n) is then calculated from Eq. 20 by substituting optimal subframe $\overline{c}(n)$ for subframe c(n). Finally, unquantized gain $\overline{G}$ is computed according to the relationship:

$$\overline{G} = \frac{\sum_{n=0}^{59} t_B(n)\overline{q}(n)}{\sum_{n=0}^{59} [\overline{q}(n)]^2} \tag{28}$$

Using quantized gain levels $G_L$ provided from quantized gain table 128, excitation selector 126 quantizes gain $\overline{G}$ to produce fixed excitation gain G using a nearest neighbor search technique. Gain table 128 contains the same gain levels $G_L$ as in the scalar quantizer gain codebook employed in the G.723 coder. Finally, the combination of parameters $m_j$, $s_j$, and G for each subframe i, where i runs from 0 to 3and j runs from 1 to M in each subframe i, is supplied from excitation selector 126 as fixed excitation parameter set $F_E$.

Figure 9:
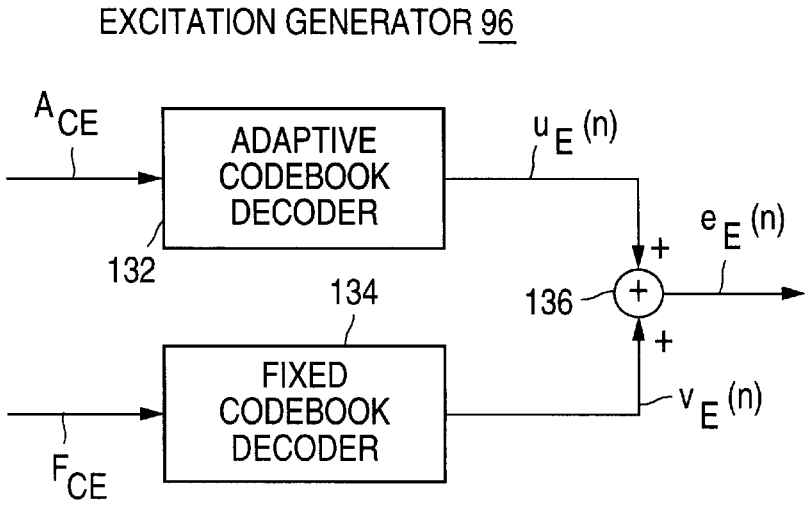

Excitation generator 96, as shown in FIG. 9, consists of an adaptive codebook decoder 132, a fixed codebook decoder 134, and an adder 136. Decoders 132 and 134 preferably operate in the manner described in paragraphs 2.18 and 2.17 of the July 1995 G.723 specification.

Adaptive codebook parameter set $A_{CE}$, which includes optimal closed-loop period $\overline{l}_i$ and optimal pitch coefficient index $\overline{k}_i$ for each subframe i, is supplied from excitation parameter saver 94 to adaptive codebook decoder 132. Using parameter set $A_{CE}$ as an address to an adaptive excitation codebook containing pitch period and pitch coefficient information, decoder 132 decodes parameter set $A_{CE}$ to construct adaptive excitation subframes $u_E(n)$.

Fixed excitation parameter set $F_{CE}$, which includes pulse positions $m_j$, pulse signs $s_j$, and quantized gain G for each subframe i with j running from 1 to M in each subframe i, is furnished from parameter saver 94 to fixed codebook decoder 134. Using parameter set $F_{CE}$ as an address to a fixed excitation codebook containing pulse location and pulse sign information, decoder 134 decodes parameter set $F_{CE}$ to construct fixed excitation subframes $v_E(n)$ according to Eq. 16.

For each subframe i of the current speech frame, adder 136 sums each pair of corresponding excitation subframes $u_E(n)$ and $v_E(n)$ on a sample by sample basis to produce composite excitation subframe $e_E(n)$ as:

$$e_E(n) = u_E(n) + v_E(n)\ ,\ n=0,1, \ldots 59 \tag{29}$$

Excitation subframe $e_E(n)$ is now fed back to adaptive codebook search unit 90 as mentioned above for updating adaptive excitation codebook 102. Also, excitation subframe $e_E(n)$ is furnished to memory update section 86 in subframe generator 54 for updating the memory of the combined filter represented by Eq. 9.

In the preceding manner, the present invention furnishes a speech coder which is interoperable with the G.723 coder, utilizes considerably less computation power than the G.723 coder, and provides compressed digital datastream $x_C$ that closely mimics analog speech input signal x(t). The savings in computation power is approximately 40%.

While the invention has been described with reference to particular embodiments, this description is solely for the purpose of illustration and is not to be construed as limiting the scope of the invention claimed below. For example, the present coder is interoperable with the version of the G.723 speech coder prescribed in the July 1995 G.723 specification draft. However, the final standard specification for the G.723 coder may differ from the July 1995 draft. The principles of the invention are expected to be applicable to reducing the amount of computation power needed in a digital speech coder interoperable with the final G.723 speech coder.

Furthermore, the techniques of the present invention can be utilized to save computation power in speech coders other than those intended to be interoperable with the G.723 coder. In this case, the number $n_F$ of samples in each frame can differ from 240. The number $n_G$ of samples in each subframe can differ from 60. The hierarchy of discrete sets of samples can be arranged in one or more different-size groups of samples other that a frame and a subframe constituted as a quarter frame.

The maximization of correlation C could be implemented by techniques other than that illustrated in FIG. 8 as represented by Eqs. 22–26. Also, correlation C could be maximized directly from Eq. 18 using Eqs. 19 and 20 to define appropriate normalized synthesized subframes q(n). Various modifications and applications may thus be made by those skilled in the art without departing from the true scope and spirit of the invention as defined in the appended claims.

I claim:

1. Apparatus comprising a speech encoder that contains a search unit for determining excitation information which defines a non-periodic excitation group of excitation pulses each of whose positions is selected from a corresponding set of pulse positions stored in the encoder, each pulse selectable to be of positive or negative sign, the search unit determining the positions of the pulses by maximizing the correlation between (a) a target group of time-wise consecutive filtered versions of digital input speech samples provided to the encoder for compression and (b) a corresponding synthesized group of time-wise consecutive synthesized digital speech samples, the synthesized sample group depending on the pulse positions available in the corresponding sets of pulse positions stored in the encoder and on the signs of the pulses at those pulse positions.

2. Apparatus as in claim 1 wherein the correlation maximization entails maximizing correlation C given from:

$$C = \sum_{n=0}^{n_G-1} t_B(n)q(n)$$

where n is a sample number in both the target sample group and the corresponding synthesized sample group, $t_B(n)$ is the target sample group, q(n) is the corresponding synthesized sample group, and $n_G$ is the total number of samples in each of $t_B(n)$ and q(n).

3. Apparatus as in claim 2 wherein the search unit comprises:

an inverse filter for inverse filtering the target sample group to produce a corresponding inverse-filtered group of time-wise consecutive digital speech samples;

a pulse position table that stores the sets of pulse positions; and a selector for selecting the position of each pulse from the corresponding set of pulse positions according to the pulse positions that maximize the absolute value of the inverse-filtered sample group.

4. Apparatus as in claim 3 wherein the correlation maximization entails maximizing correlation C given from:

$$C = \sum_{j=1}^{M} |f(m_j)|$$

where j is a running integer, M is the total number of pulses in the non-periodic excitation sample group, $m_j$ is the position of j-th pulse in the corresponding set of pulse positions, and $|f(m_j)|$ is the absolute value of a sample in the inverse-filtered sample group.

5. Electronic apparatus comprising an encoder that compresses digital input speech samples of an input speech signal to produce a compressed outgoing digital speech datastream, the encoder comprising:

processing circuitry for generating (a) filter parameters that determine numerical values of characteristics for a formant synthesis filter in the encoder and (b) first target groups of time-wise consecutive filtered versions of the digital input speech samples; and an excitation coding circuit for selecting excitation information to excite at least the formant synthesis filter, the excitation information being allocated into composite excitation groups of time-wise consecutive excitation samples, each composite excitation sample group comprising (a) a periodic excitation group of time-wise consecutive periodic excitation samples that have a specified repetition period and (b) a corresponding non-periodic excitation group of excitation pulses each of whose positions are selected from a corresponding set of pulse positions stored in the encoder, each pulse selectable to be of positive or negative sign, the excitation coding circuit comprising:

a first search unit (a) for selecting first excitation information that defines each periodic excitation sample group and (b) for converting each first target sample group into a corresponding second target group of time-wise consecutive filtered versions of the digital input speech samples; and a second search unit for selecting second excitation information that defines each non-periodic excitation pulse group according to a procedure that entails determining the positions of the pulses in each non-periodic excitation pulse group by maximizing the correlation between the corresponding second target sample group and a corresponding synthesized group of time-wise consecutive synthesized digital speech samples, each synthesized sample group being dependent on the pulse positions available in the set of pulse positions for the corresponding non-periodic excitation pulse group and on the signs of the pulses at those pulse positions.

6. Apparatus as in claim 5 wherein:

the periodic excitation samples in each periodic excitation sample group respectively correspond to the composite excitation samples in the composite excitation sample group containing that periodic excitation sample group; and the excitation pulses in each non-periodic excitation pulse group respectively correspond to part of the composite excitation samples in the composite excitation sample group containing that non-periodic excitation pulse group.

7. Apparatus as in claim 6 wherein:

each first target sample group is substantially a target zero state response of at least the formant synthesis filter as excited by at least the periodic excitation sample group; and each second target sample group is substantially a target non-periodic zero state response of at least the formant synthesis filter as excited by the non-periodic excitation pulse group.

8. Apparatus as in claim 7 wherein the correlation maximization entails maximizing correlation C given from:

$$C = \sum_{n=0}^{n_G-1} t_B(n)q(n)$$

where n is a sample number in both the second target sample group and the corresponding synthesized sample group, $t_B(n)$ is the second target sample group, q(n) is the corresponding synthesized sample group, and $n_G$ is the total number of samples in each of $t_B(n)$ and q(n).

9. Apparatus as in claim 5 wherein the second search unit comprises:

an inverse filter for inverse filtering each second target sample group to produce a corresponding inverse-filtered group of time-wise consecutive digital speech samples;

a pulse position table that stores the sets of pulse positions; and a selector for selecting the position of each pulse from the corresponding set of pulse positions according to the pulse positions that maximize the absolute value of the inverse-filtered sample group.

10. Apparatus as in claim 9 wherein the correlation maximization entails maximizing correlation C given from:

$$C = \sum_{j=1}^{M} |f(m_j)|$$

where j is a running integer, M is the total number of pulses in the corresponding non-periodic excitation sample group, $m_j$ is the position of j-th pulse in the corresponding set of pulse positions, and $|f(m_j)|$ is the absolute value of a sample in the inverse-filtered sample group.

11. Apparatus as in claim 10 wherein the selector selects each pulse position by (a) searching for the value of sample number n that yields the maximum absolute value of inverse-filtered sample f(n), (b) setting pulse position $m_j$ to that value of n provided that it is a pulse position in the corresponding set of pulse positions, and (c) subsequently inhibiting that pulse position $m_j$ from being selected again when there are at least two more pulse positions $m_j$ to be selected.

12. Apparatus as in claim 10 wherein the inverse-filtered sample group f(n), n being sample number, is determined from:

$$f(n) = \sum_{j=n}^{n_G-1} t_B(j)h(j-n),\ n = 0, 1, \ldots n_G - 1$$

where $n_G$ is the total number of samples in the second target sample group, $t_B(n)$ is the second target sample group, and h(n) is a group of time-wise consecutive samples that constitute an impulse response of at least the formant synthesis filter.

13. Apparatus as in claim 5 further including a decoder that decompresses a compressed incoming digital speech datastream ideally identical to the compressed outgoing digital speech datastream so as to synthesize digital output speech samples that approximate the digital input speech samples.

14. Apparatus as in claim 13 wherein the decoder decodes the incoming digital speech datastream (a) to produce excitation information that excites a formant synthesis filter in the decoder and (b) to produce filter parameters that determine numerical values of characteristics for the decoder's formant synthesis filter.

15. Apparatus as in claim 5 wherein the encoder operates on a frame-timing basis in which each consecutive set of a selected number of digital input speech samples forms an input speech frame to which the processing circuitry applies a linear predictive coding analysis to determine a line spectral pair code for that input speech frame, each composite excitation sample group corresponding to a specified part of each input speech frame.

16. Apparatus as in claim 15 wherein the processing circuitry comprises:

an input buffer for converting the digital input speech samples into the input speech frames;

an analysis and preprocessing circuit for generating the line spectral pair code and for providing perceptionally weighted speech frames to the excitation coding circuit; and a bit packer for concatenating the line spectral pair code and parameters characterizing the excitation information to produce the outgoing digital speech datastream.

17. Apparatus as in claim 16 wherein:

240 digital input speech samples are in each input speech frame; and 60 excitation samples are in each composite excitation sample group.

18. Apparatus as in claim 5 wherein the encoder provides the outgoing digital speech datastream in the format prescribed in "Dual Rate Speech Coder for Multimedia Communications Transmitting at 5.3 & 6.3 kbits/s," Draft G.723, International Telecommunication Union, Telecommunication Standardization Sector, 7 Jul. 1995.

19. A method for determining excitation information that defines a non-periodic excitation group of excitation pulses in a search unit of a digital speech encoder, each pulse having a pulse position selected from a corresponding set of pulse positions stored in the encoder, each pulse selectable to be of positive or negative sign, the method comprising the steps of:

generating a target group of time-wise consecutive filtered versions of digital input speech samples provided to the encoder for compression; and maximizing the correlation between the target sample group and a corresponding synthesized group of time-wise consecutive synthesized digital speech samples, each synthesized group being dependent on the pulse positions in the set of pulse positions stored in the encoder and on the signs of the pulses at those pulse positions.

20. A method as in claim 19 wherein the correlation maximization step entails maximizing correlation C given from:

$$C = \sum_{n=0}^{n_G-1} t_B(n)q(n)$$

where n is a sample number in both the target sample group and the corresponding synthesized sample group, $t_B(n)$ is the target sample group, q(n) is the corresponding synthesized sample group, and $n_G$ is the total number of samples in each of $t_B(n)$ and q(n).

21. A method as in claim 19 wherein the correlation maximization step comprises:

inverse filtering the target sample group to produce a corresponding inverse-filtered group of time-wise consecutive inverse-filtered digital speech samples; and determining each pulse position from the corresponding set of pulse positions according to the pulse positions that maximize the absolute value of the inverse-filtered sample group.

22. A method as in claim 19 wherein the determining step comprises:

searching for the value of sample number n that yields the maximum absolute value of $f(m_j)$, where $m_j$ is the position of the j-th pulse in the non-periodic excitation sample group, and $f(m_j)$ is a sample in the inverse-filtered sample group;

setting pulse position $m_j$ to the so located value of sample number n;

inhibiting that pulse position $m_j$ from being selected again whenever there are at least two pulse positions $m_j$ to be selected; and repeating the searching, setting, and inhibiting steps until all pulse positions $m_j$ have been determined.

* * * * *